US008113365B2

(12) United States Patent
Brown et al.

(10) Patent No.: US 8,113,365 B2
(45) Date of Patent: Feb. 14, 2012

(54) FULLY VENTED NURSING BOTTLE WITH SINGLE PIECE VENT TUBE

(75) Inventors: Craig E. Brown, Mt. Zion, IL (US); Robert J. Brown, Chesterfield, MI (US)

(73) Assignee: New Vent Designs Inc., Mt. Zion, IL (US)

( * ) Notice: Subject to any disclaimer, the term of this patent is extended or adjusted under 35 U.S.C. 154(b) by 433 days.

(21) Appl. No.: 12/321,455

(22) Filed: Jan. 21, 2009

(65) Prior Publication Data

US 2010/0181277 A1 Jul. 22, 2010

(51) Int. Cl.
*A61J 9/04* (2006.01)

(52) U.S. Cl. ..... 215/11.5; 215/11.1; 215/902

(58) Field of Classification Search ..... 215/11.1, 215/11.3, 11.4, 902
See application file for complete search history.

(56) References Cited

U.S. PATENT DOCUMENTS

| | | | | |
|---|---|---|---|---|
| 189,691 | A | 4/1877 | Briere | |
| 345,518 | A | 7/1886 | Lelievre | |
| 598,231 | A | 2/1898 | Roderick | |
| 679,144 | A | 7/1901 | Hardesty | |
| 834,014 | A | 10/1906 | Lyke | |
| 927,013 | A | 7/1909 | Van Cleave | |
| 1,441,623 | A | 1/1923 | Davenport | |
| 1,600,804 | A | 9/1926 | Donaldson | |
| 2,061,477 | A | 11/1936 | Perry | |
| 2,156,313 | A | 5/1939 | Schwab | |
| 2,239,275 | A | 4/1941 | Schwab | |
| 2,483,979 | A * | 10/1949 | Morrill | 219/437 |
| 2,610,755 | A | 9/1952 | Gits | |
| 2,742,168 | A | 4/1956 | Panetti | |
| 5,570,796 | A | 11/1996 | Brown et al. | |
| 5,573,507 | A * | 11/1996 | Moser et al. | 604/77 |
| 5,779,071 | A | 7/1998 | Brown et al. | |
| 7,150,370 | B2 * | 12/2006 | Pyun | 215/11.5 |
| 7,172,086 | B2 | 2/2007 | McKendry et al. | |
| 7,537,128 | B2 * | 5/2009 | Nachumi | 215/11.5 |
| 7,798,347 | B2 * | 9/2010 | Rees | 215/11.5 |
| 2004/0089626 | A1 * | 5/2004 | Pyun | 215/11.5 |
| 2005/0184022 | A1 | 8/2005 | Dunn et al. | |
| 2005/0236353 | A1 * | 10/2005 | Hsu | 215/11.5 |
| 2006/0043048 | A1 | 3/2006 | Brown et al. | |

FOREIGN PATENT DOCUMENTS

| | | |
|---|---|---|
| GB | 273185 | 6/1927 |
| GB | 454053 | 9/1936 |

* cited by examiner

*Primary Examiner* — Tri Mai
(74) *Attorney, Agent, or Firm* — Paul M. Denk

(57) ABSTRACT

A nursing bottle formed of a small volume container, incorporating a venting tube that extends to dissipate pressure at all times. The nursing bottle may have a cylindrical shape or other configuration that prevents formula placed therein from blocking the venting tube when held at any angle. The venting tube extends distally from the insert portion, operatively associated with a collar that holds the vent structures and the nipple to the neck of the container. The vent opens at the volumetric center of the reservoir above the venting tube. Alternatively, the venting tube has a conical shape of decreasing diameter distally toward the center of the bottom to dissipate the pressure that may cause leakage from the bottle.

9 Claims, 15 Drawing Sheets

FULLY VENTED NURSING BOTTLE WITH SINGLE PIECE VENT TUBE

CROSS-REFERENCE TO RELATED APPLICATION

This non-provisional application for patent claims priority to the provisional application 60/773,265 which was filed on Feb. 14, 2006, which claims priority to the non-provisional patent application Ser. No. 11/258,966 which was filed on Oct. 25, 2005, which claims priority to the non-provisional patent application Ser. No. 11/152,320 which was filed on Jun. 14, 2005, which claims priority to the non-provisional patent application having Ser. No. 10/283,878, which was filed on Oct. 30, 2002; which was filed during the pendency of PCT application Serial No. US2001/014,365 which was filed on May 4, 2001 designating the U.S., and which claimed priority to U.S. provisional application Ser. No. 60/202,851 filed on May 8, 2000.

This provisional application for patent further claims priority to the design patent application Ser. No. 29/226,482 which was filed on Mar. 29, 2005.

BACKGROUND OF THE INVENTION

The fully vented nursing bottle with integral single piece vent tube relates generally to infant serving products. More specifically, the present invention refers to nursing bottles having an internal venting tube that prevents a vacuum within the bottle and assists any infant, including a premature infant, to suck liquid from the bottle.

A unique aspect of the present invention is the single piece construction of a vented insert and a reservoir that cooperate and fully vent the feeding container while preventing leakage from the container. The present invention also includes an expanding diameter venting tube that expands superiorly to form into the reservoir, which is attached to the insert. The insert rests upon the opening of the feeding container and the entire venting mechanism provides for full venting during both usage.

Newborns and older infants are in need of sustenance in the form of calories, hydration, vitamins, and minerals. Initially, infants require feeding every two to four hours and occasionally more often. Traditionally, breast-feeding has supplied the aforementioned sustenance. Babies have the instinct to suckle milk from their mothers. However, at times, breast milk is inadequate, does not appear, or the infant's mother lacks the ability to breast feed her infant. Also, other factors may interfere with the infant receiving adequate hydration and nutrition. An infant may be premature or have anatomical changes that may interfere with feeding, such as a cleft lip or palate, or have developmental changes that preclude adequate breast feeding.

For a variety of reasons though, babies often drink liquids from other sources. Babies lack the ability to drink from ordinary glasses and cups without spilling. So, liquids are fed to babies using baby or nursing bottles. A nursing bottle features a nipple silicone, latex, rubber or other material with a hole in its tip secured across an opening in the top of the nursing bottle. The current nursing bottle is used by filling the bottle with a liquid, inserting the venting structure, securing the nipple, inverting the bottle, and placing the nipple into the baby's mouth and the baby takes it from there.

Early on, inventors created closed containers to assist feeding infants. The original feeding devices consisted solely of a container with a pliable end that was nipple shaped. With this arrangement, instant and significant negative pressure instantly builds within the interior, or inner space, of the container. An analogous situation occurs when an individual ascends in an airplane and the pressure in the middle ear fails to equalize as the pressure decreases within the airplane, causing a significant amount of ear pain. In a baby bottle, this large vacuum causes a larger negative pressure to form intra-orally in order to withdraw the feeding liquid form the bottle. This is basically identical to the pressure that forms when the infant sucks on its thumb or pacifier, and when airplane travel causes ear pain. All of these pressures have been shown to contribute to the formation of ear fluid, ear infections, speech and motor delay, and delayed cognitive development.

The prior art then introduced a slit, or defect, in the rim of the feeding nipple, to allow air to enter the container as the negative pressure accumulates. This adaptation slowly and partially vents the bottle after a vacuum forms while the infant feeds and exposes the infant to the detrimental effects of negative pressure as previously described. The adaptation also contaminates the feeding liquid as air percolates through the feeding liquid that the infant then swallows, or ingests. The ingested air is known to cause colic, fussiness, reflux, and gas induced abdominal pain.

Currently, other nursing bottles, except those by the inventors, are tightly sealed but for the opening in the feeding end of the nipple and the venting slot, or hole, in the flange of the nipple, the bottom of the container, or other locations on a bottle. In bottles, except those by the inventors, as the baby nurses, the volume of liquid in the bottle decreases and the vacuum in the bottle increases proportionally. Also, the liquid becomes contaminated by the air bubbles percolating through the liquid as it emanates from the venting slit, or hole, in the container. However this invention and the other patented devices of the inventors use vent tubes that allow ambient air to enter the bottle behind the liquid while the baby suckles. This venting structure eliminates any vacuum within the bottle created by the suckling baby. The vacuum is continuously and automatically vented. The vent tube improves the flow of liquid out of the nipple and makes it easier for the baby to suckle. The baby faces less risk of sucking in air and the resulting colic.

The negative pressures, or vacuums, in the unvented and undervented containers previously described and the air introduced into undervented containers are not physiological variables but rather mechanical shortcomings that can cause significant infant morbidity. It is well known that breast feeding involves a positive pressure within the breast. The positive pressure has been measured by inserting canulas into the ducts of a breast.

Infant and infant feeding containers originally had a narrow superior orifice to which the nipple was attached. Caregivers noted that the narrow opening prevented ready access to the interior of the bottle and prevented easy cleaning of the interior of the bottle. Manufacturers then addressed that shortcoming with bottles having larger diameter openings. Those bottles have met with sales success in the marketplace.

The larger openings called for manufacturing and usage of nipples and feeding spouts with larger diameter flanges to mate with the opening of the bottle. The larger diameter flanges prevented leaks where the nipples joined to the bottles. However, the larger diameter nipples, retaining the same distance from the superior to the inferior end of the nipple, have a larger volume of air contained by the nipples.

Further, infants often chew upon nipples though nipples remain designed for suckling to remove fluid from a container. Nipples and other feeding accessories therefore have toughened designs to resist chewing. Chewing of nipples arises more often in infants with feeding problems, such as neurological delays or deficits. The neurological delays induce a frequent chewing motion by the infant upon objects placed in the mouth, often nipples.

During frequent chewing on the feeding nipple, that has a larger diameter and a larger volume of air than nipples of standard size, the infant can compress this air distally into the bottle itself, thereby increasing the pressure upon the interior of the bottle. The increased pressure may possibly force liquid distally into a venting tube located within the bottle. The liquid under pressure may traverse the vent tube and enter the vent insert, and then possibly exit the bottle. The pressurized liquid can only occur when using larger diameter nipples in combination with reservoirs that utilize un-tapered, or straight, venting tubes. Further, when a cylindrical vent tube is replaced with a conical vent tube in the present invention, the incidence of liquid moving up the vent tube can no longer occur as an infant compresses the large volumetric nipple.

A type of feeding container using a collapsible bag has been introduced, but is messy, expensive, and provides a negative feeding pressure in the last two ounces of feeding liquid. A feeding container from Offman, with a vent in the side of the neck of the bottle has been introduced, but its design prevents cleaning and its reservoir leaks. Previously, the Applicants have introduced a vented container using a venting tube and reservoir formed in two pieces. The Applicants' prior inventions consist of a feeding container and a venting mechanism that provides for full and continuous venting, without leaks, and without percolation of air through the feeding liquid.

Other applications requiring fluid distribution without the antagonistic effects of a vacuum and without air contamination of the liquid can benefit from a fully vented container which provides for the egress of fluid at a desired rate.

Many other attempts have been made to provide a nursing bottle with an air vent to reduce the creation of a vacuum during suckling. An early patent to Roderick, U.S. Pat. No. 598,231 has a nursing bottle with a U shaped tube. However, the average baby, upon uplifting a bottle, had some liquid retained in the U shaped tube. The retained liquid blocked the tube and prevented ambient air from releasing any vacuum within the bottle. Other patents show related types of technology, and provide means for venting air from the interior of a container, as can be seen in the U.S. patent to Van Cleave, U.S. Pat. No. 927,013. In addition, the patents to Davenport, U.S. Pat. No. 1,441,623 and to Perry, U.S. Pat. No. 2,061,477, show other means for venting air from within a nursing bottle.

In the preceding work of these applicants, U.S. Pat. Nos. 5,779,071 and 5,570,796, venting and internal tubes prevent the formation of partial vacuums during suckling and also resisted spills. The '071 patent provides a venting tube that extends into a bottle and a reservoir. The venting tube has a hollow cylindrical shape projecting sufficiently downwardly into the bottle. The '796 patent provides a reservoir located above a mark on the bottle. The reservoir communicates with a conduit system to replace suckled liquid with air from the exterior of the feeding container by allowing air to enter the reservoir thus to the bottom of the container, preventing a partial vacuum in the bottle when in the feeding position. Nursing bottles of a multitude of designs are available in the prior art. In all instances, except for the patented devices of the inventors, a vacuum will be generated within the bottle during dispensing of its contents, as when nursing an infant. A vacuum is believed to cause various physiological impairments to the infant when subjected to this type of condition. The vacuum generated within the bottle, due to the infant's sucking, can cause pressure imbalance at the location of various parts of the body, such as in the ear canal, which may lead to fluid, ear infection, speech delay, motor delay, developmental delay, illness, and other impairments. Thus, the presenting of a nursing bottle that incorporates air venting means, so as to prevent the creation of a vacuum inside the bottle, has been considered a desirable development in the field of infant serving products. Such can be seen in the inventors' prior patents '071 and '769, when the feeding bottle is inverted, or in the feeding position, external air enters around the threads of the bottle, into the insert, into the reservoir tube, through the venting tube to the bottom of the bottle, thereby completely eliminating all vacuum and air bubbles entrained.

The current invention provides means for venting of any vacuum within any feeding, or other container, angled, straight, wide neck or other shape, and to prevent the generation of any vacuum or pressure therein, regardless whether the nursing bottle is being used when partially or fully inverted as during consumption of its contents.

Other U.S. patents that relate to the subject matter of this invention include the U.S. patent to Briere, U.S. Pat. No. 189,691; U.S. Pat. No. 345,518, to Lelievre; U.S. Pat. No. 679,144, to Hardesty; U.S. Pat. No. 834,014, to Lyke; U.S. Pat. No. 1,600,804 to Donaldson; U.S. Pat. No. 2,156,313, and to U.S. Pat. No. 2,239,275 Schwab; U.S. Pat. No. 2,610,755, to Gits; U.S. Pat. No. 2,742,168, to Panetti; U.S. Pat. No. 2,744,696, to Blackstone; U.S. Pat. No. 3,059,707, to Wilkinson, et al; U.S. Pat. No. 5,570,796, to Brown, et al. In addition British patents No. 273,185 and No. 454,053 show related developments.

Nevertheless, the prior art containers and methods suffer from significant disadvantages except for the inventions of the Applicants. Such disadvantages include:

1 The formation of vacuums that prevent oral feeding by infants with cerebral palsy, cleft lip, cleft palate, and other feeding difficulties.

2 The formation of vacuum within a container that prevents or delays premature infants from going home promptly when the premature infants have a poor sucking reflex or require weaning from a feeding tube.

3 The formation of vacuum within a container that prevents or suppresses close bonding contact between caregivers and premature infants that have a poor sucking reflex or require weaning from a feeding tube.

4 The formation of vacuum within a container that prolongs hospitalization and increases costs for premature infants that have a poor sucking reflex or require weaning from a feeding tube.

5 Manufacturing for prior art containers has a high cost for the components including the container, vent parts, and collapsible bags.

6 Because of cost, reusable feeding containers are used repeatedly thus incurring sterilization and handling costs.

7 In the hospital environment where many infants are present in one location and because of government rules and regulations, costly not intended for disposal are used and then disposed after each feeding.

8 As infants require multiple feedings per day, repeated use of prior art feeding containers increases the incidence of an infant receiving a feeding container previously used by another infant or an ill infant.

9 Because hospital staff, including nurses, use and reuse a small number of containers and keep each infant on the same type of container first used by the infant, again the incidence rises of an infant receiving a feeding container previously used by another infant or an ill infant.

10 Also, the parents of an infant will likely reuse a small number of containers and keep their infant on the same container that the infant likes, which again increases the incidence of their infant receiving a feeding container previously used in a hospital nursery by another well or ill infant.

11 Often, ill infants with varying severity of illness, require feedings not just multiple times per day but also multiple times per hour which increases the possibility of contamination when non-disposable containers are reused.

12 The prior art bottles, except those of the inventors, do not provide an internal vent system and mechanism for containing fluids which keeps the air vent ports clear of feeding liquid. Therefore the prior art bottles, except those of the inventors, often leak when held improperly.

13 Parents, hospital staff, nurses, and relatives report that leakage from vent holes in prior art bottles, other than those of the inventors, causes problems.

14 When prior art bottles release feeding liquid, a vacuum, or negative pressure occurs in non-vented or partially vented bottles.

15 Any vacuum existing in a prior art bottle, except those by the inventors, induces a vacuum in the intra-oral cavity of an infant which spreads into the ears and leads to accumulation of ear fluid, ear infections, speech and motor delays, and cognitive delay among other unhealthy maladies.

16 Prior art bottles, except those of the inventors, that cause a vacuum have a difficult and irregular release of the feeding liquid.

17 Vacuum formation in prior art bottles, except those of the inventors, prevents an infant from feeding on demand, the preferred method of feeding.

18 Frequently, prior art bottles, except those of the inventors, introduce air into the feeding liquid that gets ingested by an infant. The ingested air contributes to colic, irritability, fussiness, and abdominal gas pain.

19 Further, vacuum formation prevents the use of a feeding liquid container without a positive pressure liquid source powered by a pump to overcome the negative pressure within prior art bottles, except those of the inventors. Such pumps burden parents and hospital staff with mechanical devices and higher cost.

20 To overcome the vacuum in prior art closed containers, except those of the inventors, a vent hole can be placed in the body of the fluid filled container. The vent hole, particularly its location, creates a void through which feeding liquid readily escapes, or leaks, and contaminates the immediate area along with decreasing the amount of feeding liquid remaining in the container.

21 In prior art bottles, except those of the inventors, precise release of feeding liquid has proven difficult as the release is irregular due to the gradual rise of the negative pressure.

22 Additionally, vent holes in prior art containers, except those of the inventors, ostensibly for leakage prevention, prove difficult to keep clean thus fostering contamination of feeding liquid by bacterial growth.

The present art overcomes the limitations of the prior art, that is bottles that vent through a void in the flange of the nipple, or container, where a need exists for reducing vacuum inside nursing bottles. That is, the art of the present invention, a single piece tube with laterally vented insert allows air to exit rapidly and distally from a tube into the bottom of the bottle and liquid to flow promptly into a reservoir thus eliminating the formation of a vacuum within a nursing bottle. The enlarged proximal portion of the vent tube minimizes the incidence of leakage from the bottle. The present invention cleans easily, endures inadvertent chewing, and dissipates pressure generated by chewing. The present invention prevents leaks and continuously vents a bottle, thus eliminating any air bubbles in the vent tube.

Additionally, the present invention presents the following advantages:

1 The elimination of vacuums fosters oral feeding by infants with cerebral palsy, cleft lip, cleft palate, and other feeding difficulties.

2 The elimination of a vacuum within a container cuts days off the time before premature infants can go home because they reinforce their sucking reflex and are weaned more quickly from a feeding tube.

3 The complete elimination of vacuum within a container fosters close bonding contact between caregivers and premature infants that have a poor sucking reflex or require weaning from a feeding tube, leading to happier infants.

4 The complete elimination of vacuum within a container shortens hospitalization and reduces costs for premature infants that can be weaned more quickly from a feeding tube.

5 Manufacturing for the present invention has a low cost for the components including the container and vent parts.

6 Because of the low cost, the components of the present invention are disposable.

7 In the hospital environment where infants receive care in groups, the inexpensive, fully-vented, non-aerating infant feeding container of the present invention is designed to be discarded following each feeding.

8 As infants require multiple feedings per day, the present invention can be discarded due to its low cost, which decreases the incidence of an infant receiving a feeding container previously used by another infant or an ill infant.

9 As hospital staff, including nurses, have a small number of containers, some prepackaged with formula. The present invention allows use of any type of preferred formula.

10 The parents of an infant likely have a limited number of containers, some prepackaged with formula, are able to keep their infant on its preferred container, which again decreases the incidence of an infant receiving a feeding container previously used by another infant in a hospital nursery or an ill infant.

11 The present invention does not call for reuse as a durable item because it can be discarded. Without repeated use, the incidence decreases of an infant receiving a feeding container previously used by another infant or an ill infant.

12 Often, ill infants with varying severity of illness, require feedings not just multiple times per day but also multiple times per hour which the disposable feature of the present invention supports and thus decreases contamination formerly caused by reuse of bottles.

13 An internal vent system and mechanism for containing fluids is included in the present invention which keeps the air vent ports clear of feeding liquid regardless of improper holding of the container.

14 Parents, hospital staff, nurses, and relatives will benefit from a marked reduction in leaks from bottles as the present invention has no need to use vent holes.

15 When the present invention releases feeding liquid, no vacuum, or negative pressure occurs.

16 The lack of a vacuum within the present invention prevents the existence of a vacuum in the intra-oral cavity of an infant which decreases the incidence of accumulation of ear fluid, ear infections, speech and motor delays, and cognitive delay among other maladies.

17 The present invention has easy and regular release of the feeding liquid to the infant as a result of the absence of a vacuum.

18 The present invention, because there is no vacuum, encourages an infant to feed on demand, the preferred method of feeding.

19 The present invention does not introduce air into the feeding liquid that gets consumed by an infant and therefore greatly reduces the possibility of colic, irritability, fussiness, and abdominal gas pain.

20 Further, no pump is required by the present invention as no vacuum has to be overcome. Such pumps are a burden on parents and hospital staff and increase the cost of care.

21 Since, the present invention has no vacuum, vent holes are not needed in the body of the fluid filled container. The present invention has no need of a vent hole through which feeding liquid could leak, contaminate the immediate area, and also decrease the amount of feeding liquid remaining in the container.

22 The present invention provides for precise release of feeding liquid as the release is regular due to the constant positive pressure.

23 The present invention has no holes in the wall of the container as in the prior art containers, except those of the inventors, thereby making the container easier to clean and reducing the possibility of contaminating the feeding liquid with air and bacteria.

The present invention with the advantages described and avoiding the disadvantages of the prior art containers, except those of the inventors, provides infants and their care givers a container for feeding liquid with virtually no leaks, no vacuum, and little, if any, air ingested by the infant.

SUMMARY OF THE INVENTION

Previously, infant feeding bottles, except those of the inventors, had a non-vented, or partially vented container with the previously described disadvantages. The cost of prior art bottles did not allow for easy disposal. The prior art bottles also served poorly in hospitals where they were not physiological and posed health risks that typically increased infant morbidity.

The present invention provides for an economical container that permits full and continuous venting of a container of feeding liquid, and that completely eliminates formation of vacuum with the container. The present invention allows for the ready flow of feeding liquid as demanded by the infant without leaks from the container or the mixing of air within the feeding liquid. The present invention provides a feeding container that fosters normal oral, ear, respiratory, and digestive physiology; and encourages hygienic nutrition along with optimizing the feeding abilities of all infants.

Accordingly, the present invention improves the conical vent tube and reservoir within a nursing bottle by combining it with an insert into a single piece venting mechanism. The vent tube has a contoured shape generally and preferably attains a conical shape with the diameter of the cone larger superiorly and smaller inferiorly away from the reservoir portion. The conical shape admits air distally into a bottle while immediately emptying liquid itself into the reservoir of the vent tube while in the feeding position. The conical shape prevents entry of liquid into the insert portion thus venting the bottle immediately and preventing leakage of liquid from the bottle.

Additionally, the present invention provides an improved shape of the vent tube to lower internal pressures of liquids and air. Decreased transmission of pressure from wide-nipple compression is noted at the widened proximal end of the vent tube. When pressure is exerted upon the liquid in the bottle, and it rises up into the vent tube, the liquid loses its force due to the widening characteristics of the conical vent tube at its upper wider reaches. The larger diameter of the conical shape prevents the liquid in the bottle from being propelled proximally into the tube of the insert, which may cause leaks. This is due to the larger diameter of the conical shape, at the proximal end of the tube as compared to the distal end, which dissipates the pressure of the compressed air and allows the liquid to gently flow into the reservoir. This prevents propulsion of liquid into the insert, thus the conical shape prevents leaks from the bottle.

Further, the larger diameter of the conical shaped section increases the capacity of the reservoir. As the infant empties the bottle and the liquid level drops below the maximum, the liquid occupying the reservoir now, more rapidly and effectively exits the reservoir. When a caregiver or infant holds the bottle upright in the rest position, liquid promptly exits the reservoir into the larger diameter of the conical shaped tube and returns the remaining liquid to the bottle.

When the infant chews on the wide neck, large volume nipple and the cylindrical vent tube of the prior art is replaced with a conical vent tube, the possibility of the liquid being propelled up the vent tube can no longer occur. The liquid flows quickly and gently into the reservoir. The present invention allows for instant, complete, and unimpeded movement of any air bubble, present in the venting tube, to immediately exit from the distal end of the vent tube into the distal end of the bottle when the bottle is placed in the feeding position. The vent tube hereby functions in an automatic and continuous fashion as intended by the inventors.

This invention establishes a structured relationship between the container or vessel and the formula within a nursing bottle. The nursing bottle has sufficient size so that as the formula is prepared and deposited within the container, the formula's surface will be at a level below the vent port or the vent leading towards the exterior of the container, for venting purposes. In addition, even when the vessel is inverted, by the infant or caregiver, during feeding, the liquid formula still will not approach the distal insert vent in any position. Thus, the concept of this invention is to provide a container with sufficient bulk and volume, so that the formula or milk as supplied therein, whether it be in the four ounce or any size category, will always leave the identified vent port exposed to attain the attributes of venting, for the nursing bottle, at all times.

Thus, no appreciably positive pressure can occur when the bottle is being warmed for feeding and no negative pressure can build up in the container, since the vent port is always open, so as to allow for the venting of any negative pressure, internally generated within the container, that may occur as a result of the sucking action of the infant.

Some attributes of the embodiments of this invention employ features of providing sufficient internal volumetric size to the container achieved through usage of containers that are of excessive dimensions, such as being large and spherical in shape, or cylindrical in shape and flattened upon each surface, or which has a size equivalent to that of a Mason jar. In one instance, the container may be shaped in a spherical form. In another embodiment, the container will be of a cylindrical shape, but be flattened on the sides. In a further embodiment, the container may be of the jar shape, or even contain some concavity upon its sides, to facilitate its lifting. In addition, where the spherical or cylindrical type of container is used, it may have a flattened bottom, to add stability to the nursing bottle, when rested upon a surface.

In the preferred embodiment, the venting port within the insert portion cooperates with a vent tube, and at least one lateral vent aperture, that are built into the insert portion that secures to the top of the container by means of its associated threaded collar that holds the combined insert and vent tube within the vessel, or container, and the conventional nipple, in place. The vertical vent port of the insert opens directly and downwardly into the reservoir. The insert may have lateral ports to either side to allow venting as the container is being inverted during usage.

In a further embodiment, the container, collar, and nipple may be of the conventional type, but having the volumetric sizes from the shaped containers as previously explained, but the vent tube and port within the insert may extend to the exterior surface of the container, rather than cooperate with the collar, in the manner as previously described in the '071 patent.

Nevertheless, the orientation of the vent port, at its entrance point, leading from its distal end to the reservoir, can be arranged somewhere centrally of the configured container, regardless what shape or structures the containers may possess, so as to allow the liquid to be below the vent port aperture as the nursing bottle is either at rest, or being inverted as during usage, in the manner as previously explained.

Therefore, it is an object of the invention to provide a new and improved venting tube for nursing bottles of infants.

It is a further object of the present invention to dissipate the pressure upon liquid within the nursing bottle, preventing introduction of liquid into the insert portion, thus preventing leaks.

It is a still further object of the present invention to provide immediate exit of air bubbles in the venting structure to the bottom of the bottle as a bottle is inverted.

It is a still further object of the present invention to provide an apparent increase in volume of the reservoir caused by the larger diameter of the conical shape and thus immediately emptying liquid into the reservoir when the bottle is placed in the feeding position.

It is a still further object of this invention to provide a volumetric sized container for use as a nursing bottle, and which incorporates a vent tube with a reservoir combined with an insert portion that is arranged approximately centrally thereof, so that the vent port within the insert avoids coverage from any of the formula or milk contained therein, either during usage when feeding the infant, or during nonusage when the bottle has been set on its base, as during storage, while heating, or when at rest.

It is an even still further object of this invention is to provide for structured means within a nursing bottle that provides for full and continuous venting of any pressure or vacuum generated within its container, regardless of usage or nonusage of the subject bottle.

Lastly, it is another object of this invention is to provide for the structure of a wide rimmed, or other size, collar for use with a standard wide mouth container as structured into a nursing bottle, and useful for feeding formula to an infant.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
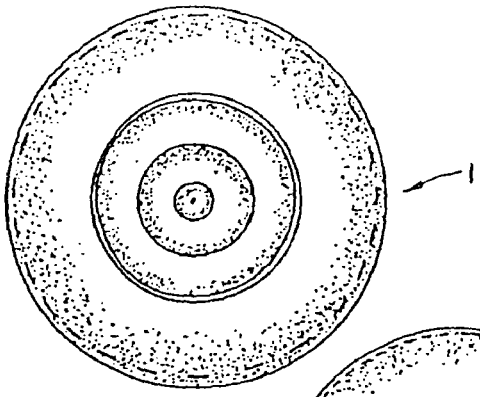
FIG. 1 is a top view of a spherical shaped nursing bottle.

The present art overcomes the prior art limitations by providing a fully vented wide rim, or other size, nursing bottle that provides a conical vent tube to eliminate vacuum within the container and prevent leakage from the container. In referring to the drawings, and in particular FIGS. 1 and 2, the fully vented, wide rim, or other size, nursing bottle preceding this invention is disclosed. It includes a spherical shaped container 1 that has ample volumetric capacity therein, so as to achieve the sought after results for this invention. That is, when a formula, such as at 2, is applied into the container, with the formula being applied at an amount that normally furnishes a feeding for the infant, it will only fill the container up to a level that is yet below the bottom of the vent tube 3, and more specifically distally to the insert and its vent port 4, as can be noted.

Thus, any vacuum built up within its container will be immediately vented to the atmosphere, because of the openness of the vent port 4 of the distal insert, to absorb any generated vacuum, no matter how slight, and allow it to be vented to the atmosphere, externally of the shown nursing bottle. The nipple 5, the threaded collar 6, and the vent insert 7, that are threadedly applied to the upper edge of the container 1, are all fabricated in the manner as previously described in the '071 patent with the exception that these components may also be fabricated of a wider dimension, so as to fit upon a wide rim style of opening for the shown container 1, thereby providing the type of ample volumetric capacity for the nursing bottle, an any appropriate size of nipple may be employed, to achieve the relationship between its structure, such as the insert and its vent port, and the level of any standard amount of formulation applied therein, during usage, to achieve the benefits of this invention. In addition, when the nursing bottle of this invention is inverted for feeding an infant, the formula may flow to the opposite side of the inverted container 1, but yet will have a surface level that will still be below the distal insert and its vent port 4, so that any sucking action generated by the infant, during feeding, and the formation of any vacuum, or partial thereof, within the container, during feeding, will be continuously vented by its vent port 4, through the vent tube 3, and out of the vent insert 7, as previously reviewed. It should be noted that the container 1 of this invention will obviously include a minor flattened surface, as at 8, at its bottom, to allow the free standing of this nursing bottle, as when not in use, when stored, or when being warmed or heated in preparation for consumption of its formula contents.

Figure 2A:
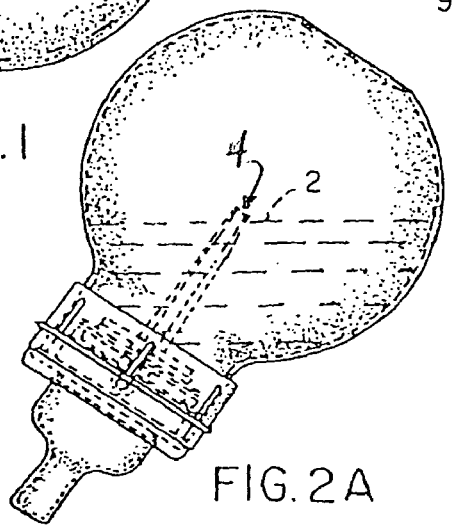
FIG. 2A is a side view of the bottle during usage.
Figure 2:
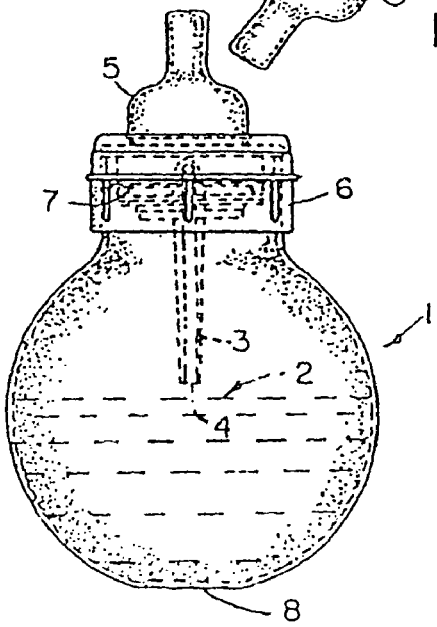
FIG. 2 is a side view thereof.

FIG. 2A shows the container 1 and its nursing bottle when inverted, as during a feeding, to disclose how the fluid level 2 will yet remain below the opened vent port 4, so as to not obstruct the venting of any partial vacuum generated therein, during the feeding process.

Figure 3:
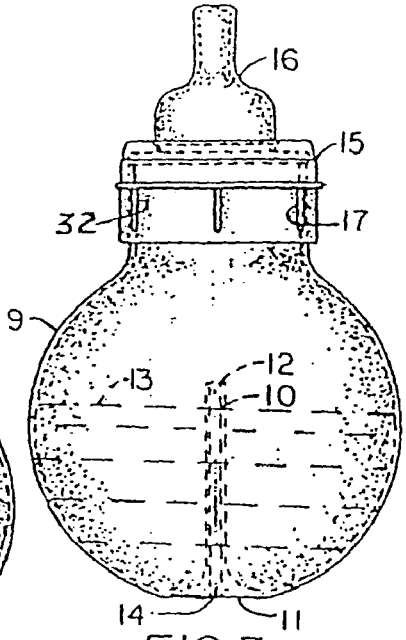
FIG. 3 shows a modification to a spherical shaped nursing bottle wherein the vent tube extends structurally upwardly from its bottom.
Figure 4:
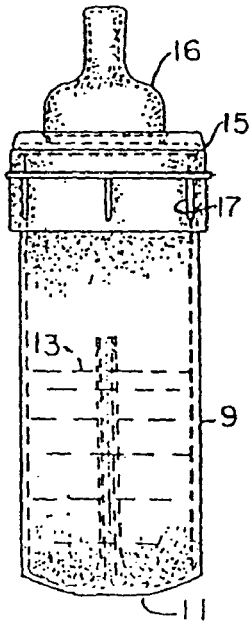
FIG. 4 is a side view of the nursing bottle of FIG. 3.

FIGS. 3 and 4 disclose a modification to the shape of the container 9 for the shown nursing bottle, with the further modification that the vent tube 10 will be integrally structured with the bottom 11 of the shown container, disposing its vent port generally centrally of the container, as can be noted at 12. Thus, regardless at what position the container 9 of this nursing bottle may undertake, the surface level 13 of the formula will not obstruct the entrance of any air flow into the vent port 12, for venting purposes, in this case, out of the bottom opening 14 of the shown vessel. This is so regardless whether the container 9, as during storage, or feeding, may be positioned vertically, as shown in FIG. 3, or inverted, as can be understood. In this particular instance, the threaded collar 15 and nipple 16 are conventional, and threadedly engage to the wide rim 1, or alternatively a narrow rim, of the container 9, which enhances the volumetric capacity of the nursing bottle, during usage, and to attain the results desired and required for this particular development. In addition, the structure of a wide rim container 9, or alternatively a narrow rim, is generally spherical, as can be noted in FIG. 3, but flattened on its front and back surfaces, as disclosed in FIG. 4, and yet attains the volumetric capacity for the formula, as desired and required for this development.

Figure 5:
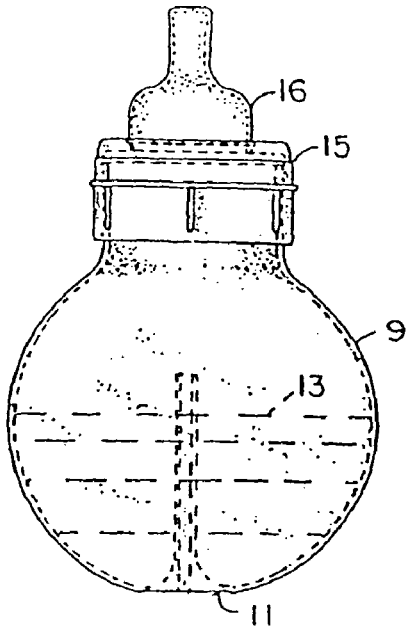
FIG. 5 is a back view of the nursing bottle of FIG. 3.
Figure 6:
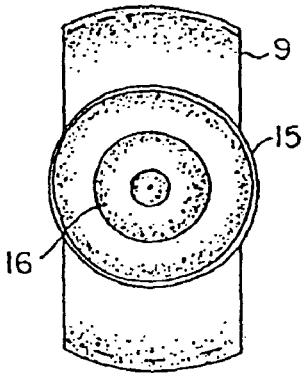
FIG. 6 is a top view thereof.
Figure 11:
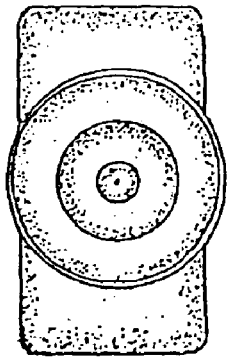
FIG. 11 is a top view thereof.
Figure 12:
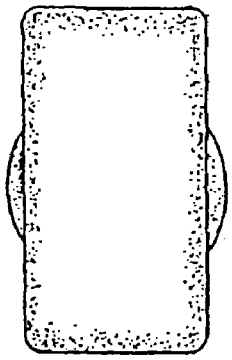
FIG. 12 is a bottom view thereof.
Figure 10:
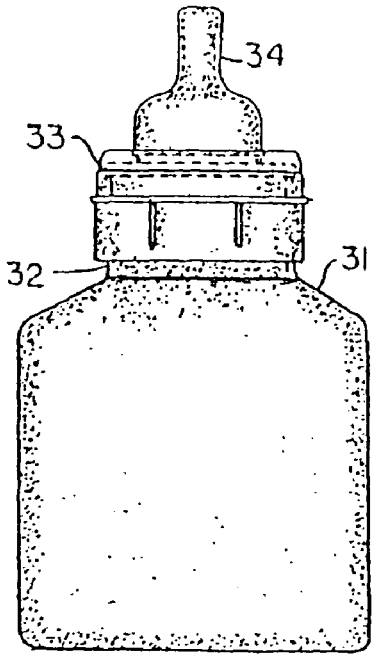
FIG. 10 is a front view of a wide structured nursing bottle of a rectangular configuration having its collar and nipple applied to a wide rim at its upper end.

FIGS. 5 and 6 provide both a back view, and top view, of the modified nursing bottle as previously described in FIGS. 3 and 4.

Figure 7:
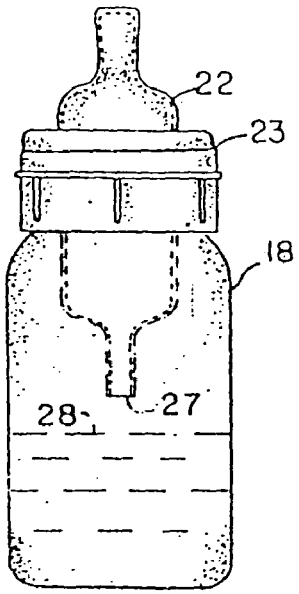
FIG. 7 is a side view of a modified form of nursing bottle having a wide rim configuration for mounting of its collar and nipple, and supporting the vent structure therein.
Figure 9:
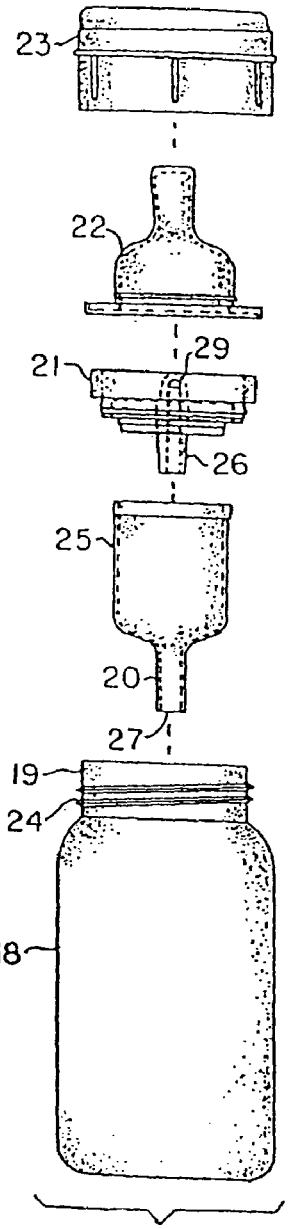
FIG. 9 is an exploded view of the operative components of the structured nursing bottle as shown in FIG. 7.
Figure 8:
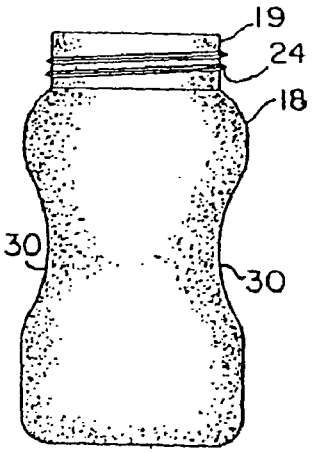
FIG. 8 is a side view of the nursing bottle as shown in FIG. 7.

FIGS. 7 through 9 show a further modified nursing bottle of this invention, wherein its container 18 has a Mason jar style of configuration, thereby affording the wide rimmed 19 style of opening, at its upper end, for accommodating the vent tube 20, reservoir or receptacle portion 25, the vent insert 21, the nipple 22, and the threaded collar 23, that all threadedly engage onto the threads 24 of the shown container. These components 20 through 23 and 25 are very similar in structure to that as previously described in the '071 patent with the exception that the components may be fabricated to a wider dimension, in order to be accommodated upon the wide rimmed opening 19 of the shown container 18.

The vent tube communicates with its upper inner receptacle portion 25, forming the reservoir-like configuration as noted, and which positions thereon and locates therein the internal vent tube 26 of the vent insert 21, to function in the manner as previously explained in the '071 patent. But in this particular instance, it should be noted that the vent port 27 of the vent structure, as all mounted to the wide rim of the volumetric container 18, when inserted, is disposed approximately at the center of the internal space of the shown container 18, in order to achieve the benefits and results as explained for this embodiment. Hence, the surface level 28 of the formula applied therein will always be below the entrance to the vent port 27, so as to avoid its blockage, regardless whether the container 18 is maintained in its rest position, as shown in FIG. 7, or when the container is tilted to any angle, or should it be inverted, placed on its side or any position, as during the feeding process. This allows the vacuum generated within the container, during feeding with the nursing bottle, to always be vented, to the atmosphere. In addition, it is to be noted, particularly upon review of the '071 patent, that wherever these vent tube and vent insert configurations are inserted upon the wide rim and held in position by means of the collar 23, that the distal insert and vent tube 26 internally communicate with the lateral vent passages 29 and opens to atmosphere internally of the collar 23, to provide venting thereof, at all times, to achieve the purposes and advantages of this invention.

It can also be noted in FIG. 8 that the sides of the container 18 may be integrally concaved, as at 30, for the gripping and holding of the larger sized bottle, during its usage.

Figure 13:
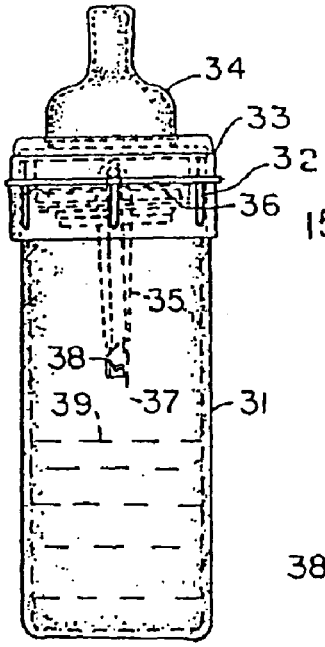
FIG. 13 is a side view thereof, and showing its internal venting structure.

FIGS. 10 through 13 disclose a larger volumetric sized nursing bottle, having a container 31 that is generally of a rectangular configuration. It may have a wide rimmed opening, as at 32 for accommodating the shown collar 33, its supported nipple 34, the vent tube 35, and the vent insert 36 when installed. The vent insert is shown more carefully in FIGS. 14 and 15, and it can be seen that the bottom of the vent port 37 is open, and venting is achieved through the lateral port 38 that extends to the front and back of the insert, to attain internal venting. In addition, the lateral port 38 is arranged above the neck of the bottle. In addition, the lateral ports 38 permit the entrance of air into the feeding container as when the nursing bottle is inverted during a feeding. Nevertheless, as can be seen in FIG. 13, the level of the liquid, or formula, will always be at a location spaced from the bottom of the vent tube 35, to attain the purposes of this embodiment. Furthermore, as can be seen in FIG. 15, and as noted from the '071 and '796 patents, the vent insert 36 has the lateral vents 38 that communicate with the vent 35, for allowing the free flow of air, thus relieving any vacuum buildup, generated within the nursing bottle during usage, to the atmosphere, externally of the bottle, in order to achieve the benefits and results of this embodiment.

Figure 16:
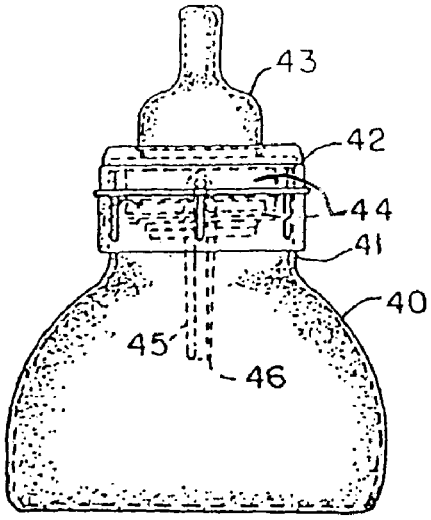
FIG. 16 is a front view of a nursing bottle having a volumetric structured vessel with the collar, vent insert and nipple applied to its wide rim top, for disposing its vent tube, and vent port approximately centrally of its shown container.

FIG. 16 shows a nursing bottle that incorporates a semi-spherical container 40, and having mounted onto its integral wide rim 41 the collar 42, nipple 43, and the vent insert 44 as noted. In addition, the vent tube 45 extends downwardly into the container 40, with the bottom 46 of the vent tube being arranged approximately, once again, at the approximate midpoint of the volumetric capacity of the nursing bottle, to achieve the benefits of this invention.

Figure 17:
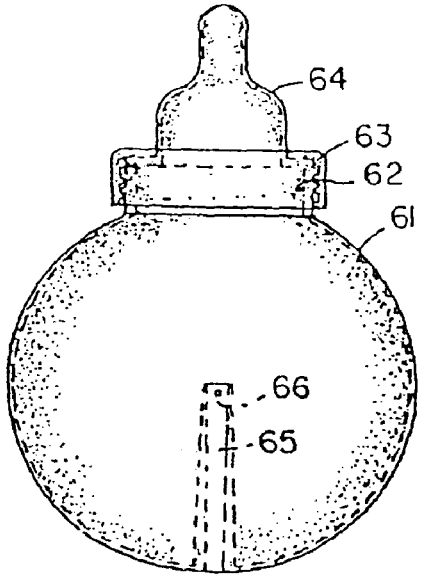
FIG. 17 is a front view of another spherical form of container for a nursing bottle having the vent tube operatively structured and disposed with its bottom segment.

FIG. 17 discloses a spherical form of nursing bottle wherein its container 61 has mounted to its standard, or wide, rim 62 by threaded engagement the collar 63 and the nipple 64, as noted.

The vent tube, in this instance, as at 65, extends integrally upwardly from the bottom of the container 61, and internally vents to the atmosphere, out the bottom of the bottle, and has at its upper end the lateral vent ports 66 as noted. Again, these vent ports are arranged at the approximate midpoint of the volumetric capacity for the shown container, to achieve the benefits of this invention.

Figure 18:
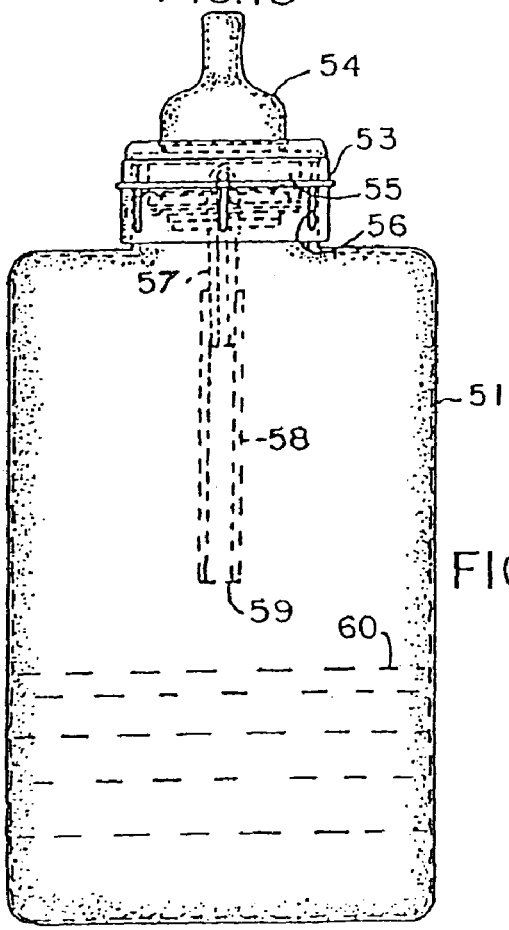
FIG. 18 is a front view of a further rectangular shaped volumetric sized container for a nursing bottle having the collar, vent insert, and vent tube, with or without an extension, all operatively associated therewith.
Figure 19:
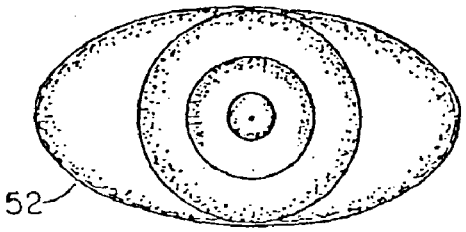
FIG. 19 is a top view of a further modified wide rim nursing bottle of this invention.

FIGS. 18 and 19 disclose a modification to the nursing bottle of this invention, wherein its container 51 is generally rectangular of configuration in one dimension, but has an oval shape 52 along its vertical disposition. Its collar 53 secures the nipple 54, and the vent insert 55 to the standard or wide rim 56 of the integral container 51, for the nursing bottle. The distal insert and its vent tube 57 extend downwardly, and include an extended vent tube 58, whereby its vent port 59 at its bottom end is disposed approximately, once again, at the volumetric midpoint of the shown container 51 for the nursing bottle. Thus, any formula 60 contained therein for feeding, will always be below the disposition of the vent port 59, regardless whether the nursing bottle is rested upright, as shown in FIG. 18, or inverted, as during feeding.

Figure 20:
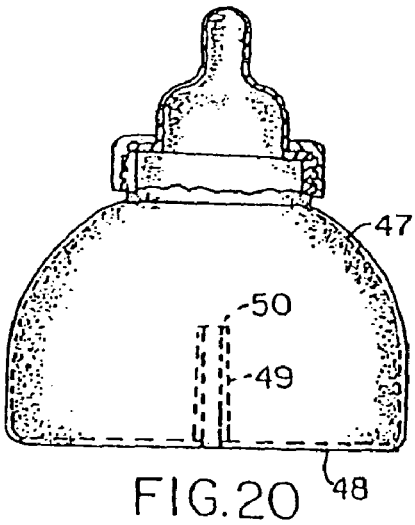
FIG. 20 is a front view thereof.

FIG. 20 shows a similar style of nursing bottle, to that of FIG. 16, but in this instance, its container 47 has integrally formed of its flattened bottom 48 an upwardly extending vent tube 49, whose upper end 50, forming the vent port, is arranged once again at the approximate volumetric midpoint of its shown container.

FIGS. 21 through 25 show variations upon the arrangement of the vent tube of this embodiment. As noted, in FIG. 21 the shown nursing bottle has its container 67 mounting upon its wide rim 68, its threaded collar 69, and the shown nipple 70. For venting purposes, in this particular embodiment, the vent tube 71 is integrally formed of the container 67, and extends radially inwardly, along an oblique angle, into the approximate midpoint of the shown container, having its vent port 72 disposed approximately at this location, as noted.

Thus, any formula 73 provided therein, of the amount normally fed to an infant, will always be below the entrance to the vent port 72, and not cause any leakage thereof. This is so regardless whether the nursing bottle is being stored, or inverted as during usage.

Figure 22:
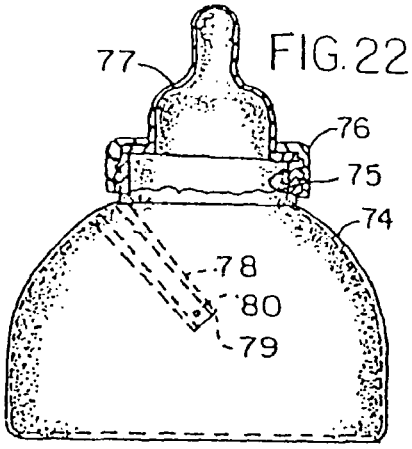
FIG. 22 is a further modified wide rim nursing bottle having its oblique vent tube extending inwardly from the approximate upper surface of its container.

FIG. 22 shows the hemispherical style of container 74 for the shown nursing bottle. The bottle has a standard, or wide, rim 75, to which the threaded collar 76 and the nipple 77 are attached.

Figure 21:
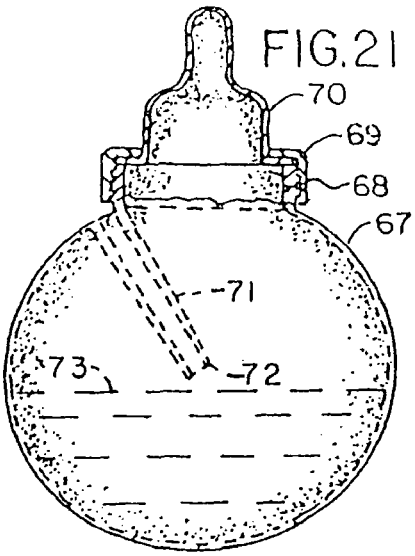
FIG. 21 is a further modified wide rim nursing bottle of this invention having its vent tube extending inwardly towards centrally from the upper container surface.

In this instance, similar to that of the bottle as described in FIG. 21, the vent tube 78 is integrally formed of the container, and is arranged obliquely within it, to dispose its vent port, as at 79, and more specifically its lateral vents 80, internally at the approximate volumetric midpoint of the shown container, to achieve the benefits of this invention.

Figure 23:
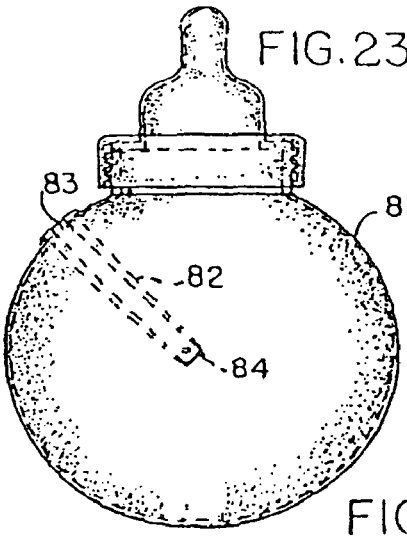
FIG. 23 is a further modified wide rim nursing bottle having the vent tube extending inwardly from the surface of its container.

FIG. 23 is similar to the structured nursing bottle as described in FIG. 21, but in this instance, as can be noted, the container 81 has its vent tube 82 arranged further down the side of the shown container, opening to atmosphere as at 83, and having its vent port 84 provided at the approximate midpoint of the shown container 81.

Figure 24:
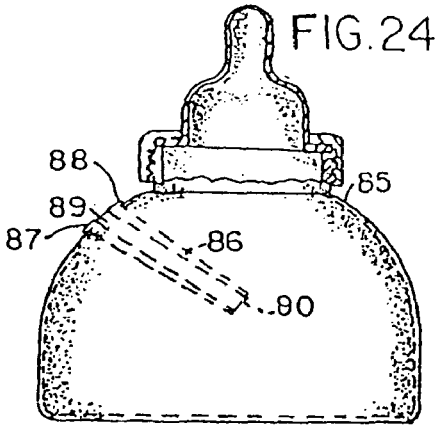
FIG. 24 is similar to the bottle of FIG. 22, with the vent tube structured further downwardly along the side of the shown bottle.

FIG. 24 shows a structure for a nursing bottle similar to that as previously explained in FIG. 22, but in this particular instance, the container 85 has its vent tube 86 integrally formed further down the side of the shown container, as can be noted at 87. This may be integrally formed, or structurally applied thereto, as by adherence of the flanges 88 to the opening 89 provided through the wall of the container 85. The inner end of the vent tube 86, has its vent port 90, arranged, once again, at the approximate volumetric midpoint of the shown container, in order to achieve the results and benefits of this embodiment.

Figure 25:
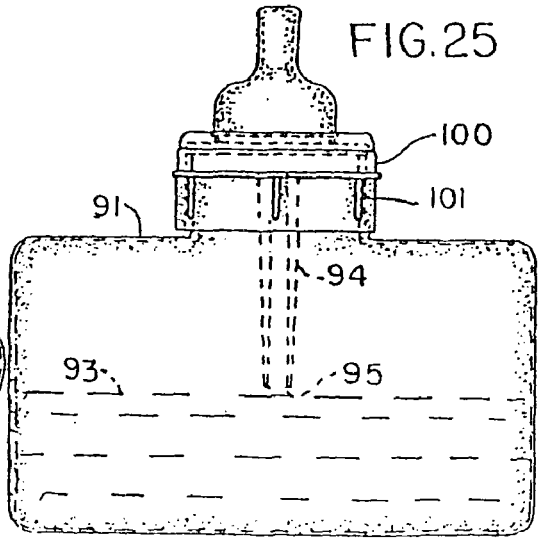
FIG. 25 is a front view of a further shaped vented nursing bottle of this invention.
Figure 26:
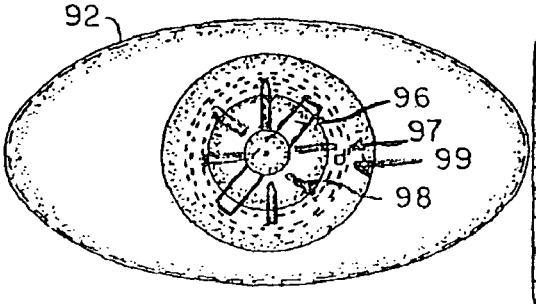
FIG. 26 is a top view of an oval shaped wide rim nursing bottle of this invention.

FIGS. 25 and 26 disclose a further modification to the nursing bottle of this invention, wherein its rectangular configured container 91 has an oval appearance along the vertical, as can be noted in FIG. 26, as at 92.

It provides sufficient volumetric capacity so that the surface of the formula added thereto, as at 93, will always be below the vent tube 94, and its vent port 95, regardless of the position undertaken by the nursing bottle, when used. In accordance with the structure of the venting characteristics of this development, and as can be seen in FIGS. 25 and 26, the vent tube 94 has lateral vents 96 that extend laterally to the sides of the vent insert 97, and which provides venting of any pressure or vacuum developed within the container 91 to the atmosphere, by passing through the configured threads 101, as can be understood from our prior patents.

As known from the '071 and '796 patents, the vent insert 97 includes a series of supporting vanes 98 that provide intermediate spacing, as at 99, and through which the formula may flow, when the nursing bottle is inverted, as during a feeding. But, the lateral vents 96 communicate with the vent tube 94, to allow passage of air eliminating the possibility of any vacuum formation. The air passes through the imperfect seal formed of the threaded connection between the collar 100, and the threads 101 through the vents of the standard or wide rimmed structure of the container 91, of the shown nursing bottle. Nevertheless, the criticality regarding the location of the vent port 95, at the approximate volumetric midpoint of the shown container 91, is essential so as to prevent any leakage from it, when formula is applied therein, so that venting can effectively occur, regardless whether the nursing bottle is being used, stored, heated, or inverted, as during feeding.

Figure 14:
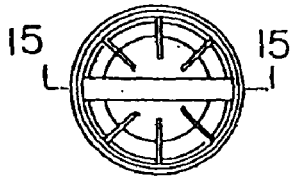
FIG. 14 is a top view of the vent insert applied within the collar when affixed to the wide rim of the container of the nursing bottle as shown in FIG. 13.
Figure 15:
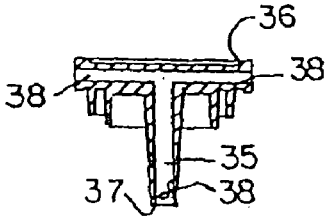
FIG. 15 is a sectional view of the vent insert, taken along the line 15-15 of FIG. 14.
Figure 27:
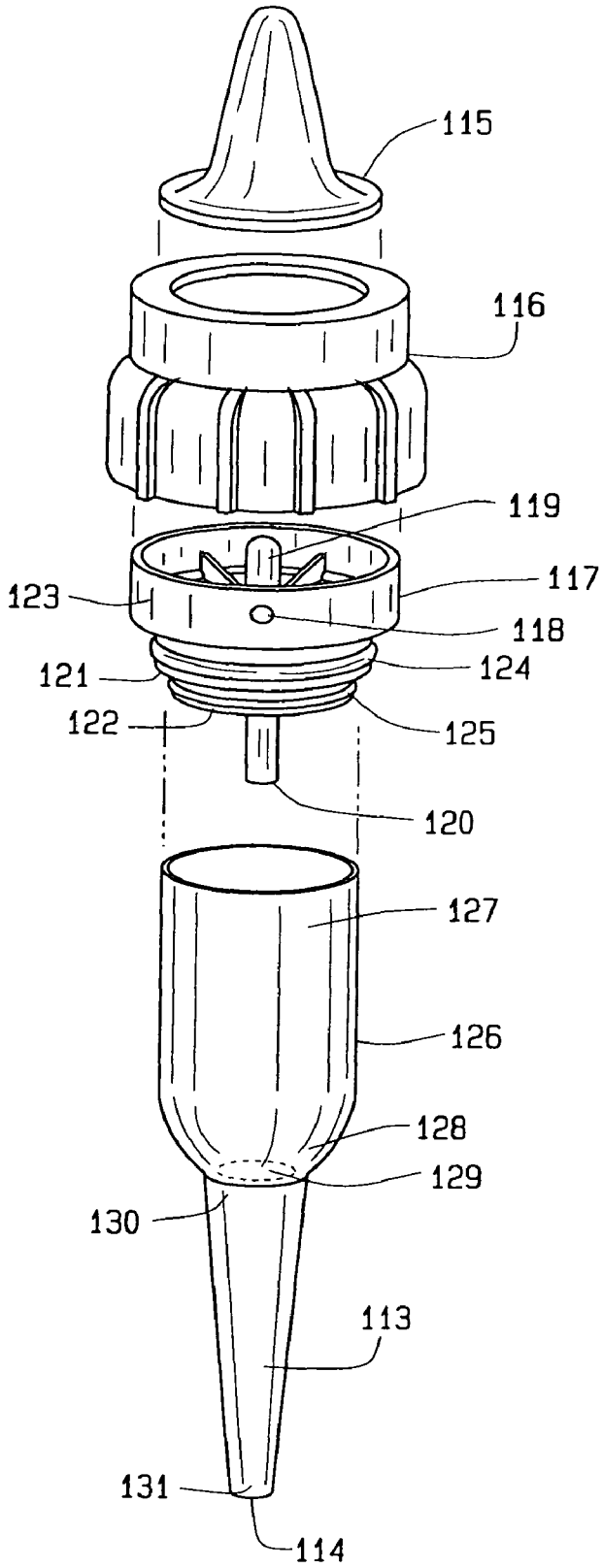
FIG. 27 is an exploded view of the vent tube and appurtenant components.
Figure 27A:
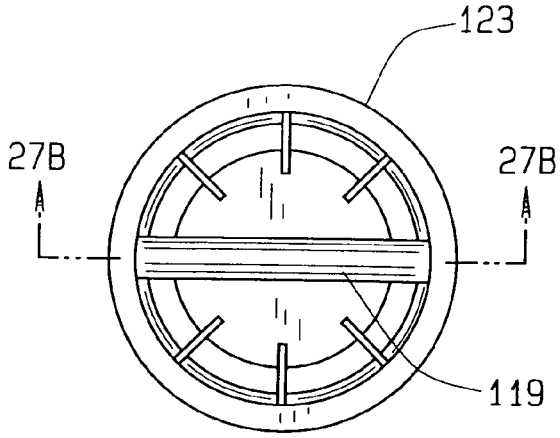
FIG. 27A is a top view of the vent insert.
Figure 27B:
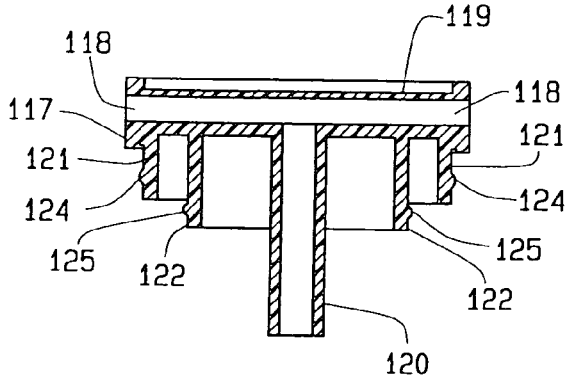
FIG. 27B is a sectional view of the vent insert.

The bottle components shown in FIG. 27 share similarities with those shown assembled previously in FIGS. 13-15. FIG. 27 shows an exploded view of the components less the liquid container or bottle. A nipple 115 extends out from a collar 116 that secures to the bottle 1 as later also shown in FIG. 31. Between the collar and the bottle, a vent insert 117 grasps the rim of the bottle 1. The vent insert has a generally hollow cylindrical shape with a low height perimeter wall 123. Across the diameter, the vent insert 117 has a lateral vent 119 with a centered hole towards the direction of the bottle as shown in FIGS. 27A, 27B. The lateral vent has two opposed openings 118 that generally communicate air between the bottle 1 and the atmosphere. The insert 117 has a major lip 121 and a minor lip 122 concentric and slightly below the major lip 121 as then shown in FIG. 27B. The vent insert 117 on its lateral surface has the major lip 121. The major lip is also a hollow cylindrical shape contiguous, but of slightly lesser diameter, than the vent insert. In this manner, the vent insert can be applied in a tight seal within the rim of the bottle, during its installation, and thereby prevent any leakage from the vent insert other than the air venting desired from the structure of the insert and its applicable usage in a nursing bottle. The aperture providing air to the bottom of the bottle, as at 114, for the contoured vent tube 113, shown here in the preferred embodiment as conical though other shapes are possible as later shown in FIG. 28. In addition, the bottom of the vent tube typically ends, in this instance, proximate to the internal bottom of any container upon which the venting structure of this invention applies, regardless of whether it be the standard bottle, a wide rim bottle, or the like. In an alternate embodiment, the aperture 114 has a circumferential rib extending around it to stiffen the exit of the reservoir. The major lip has a circumferential bulge 124 of slightly larger diameter than the major lip. The bulge of the major lip seals the insert to the inner diameter of the bottle. The major lip has an outer diameter that of the inner diameter of the bottle. Depending from the lateral vent 119, the vent insert 117 has the minor lip 122 as a hollow cylindrical shape of lesser diameter than the major lip. The minor lip 122 has a circumferential bulge 125 of slightly larger diameter than the minor lip. The minor lip has an outer diameter of the inner diameter of the reservoir. The minor lip seals the reservoir 126 of the vent tube of the present invention to the vent insert 117.

The vent tube 113 has a reservoir 126 having a generally hollow cylindrical shape with an open top 127 and a partially closed bottom 128. The bottom is smoothed and rounded as it descends distally from the top. At the center of the bottom 128, an aperture 129 provides passage to the vent tube 113 joined to the bottom. The vent tube then attains a hollow truncated conical shape with the larger diameter 130 located towards the reservoir 126 and the narrow diameter 131 located distally.

Coaxial with the vent tube 113, the vent insert 117 has the distal insert or internal vent tube 120 centered upon the hole in the lateral vent 119 and perpendicular to the lateral vent 119 within the insert wall 123. The internal vent tube 120 is a hollow cylinder of a length in excess of its diameter. The internal vent tube 120 communicates air, but not feeding liquid in the current invention, from the lateral vent 119 into the reservoir 126 of the vent tube 113.

Figure 28:
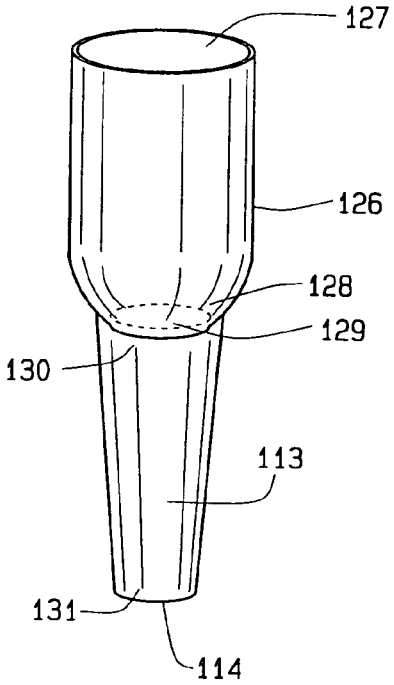
FIG. 28 is an isometric view of the conical vent tube having a large diameter proximally.

FIG. 28 shows the vent tube 113 alone and having a large diameter 130 distal to and similar in diameter to the bottom 128 of the reservoir 126. The vent tube 113 then tapers distally towards the narrow diameter 131. In the preferred embodiment, the larger diameter 130 is approximately twice that of the narrow diameter 131, in a minimum ratio of about 2:1.

Figure 29:
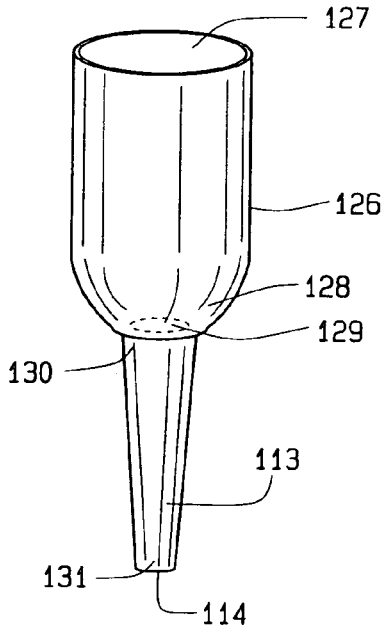
FIG. 29 is an isometric view of the conical vent tube having a narrow diameter distally.

FIG. 29 again shows the vent tube 113 but with the larger diameter 130 substantially less than previous embodiments. In this embodiment, the larger diameter 130 attains at least one eighth more than the diameter of the narrow diameter 131. Towards the narrow diameter 131, the vent tube 113 tapers distally as before. In this embodiment, the large diameter 130 is greater than the narrow diameter 131, in the range of approximately 3:1 to approximately 1:1 ratio, here shown in a ratio of about 1.1:1.0.

Figure 30:
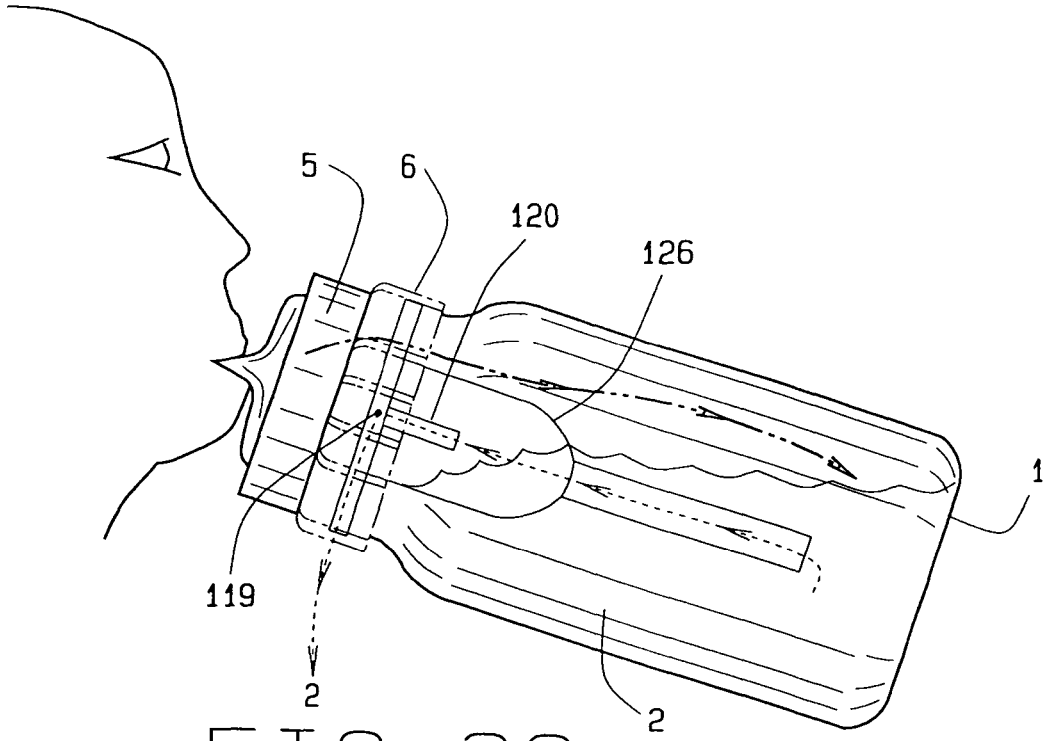
FIG. 30 PRIOR ART
FIG. 30 shows a prior art vented bottle with a cylindrical tube utilizing a wide neck bottle and showing possible leakage during use by an infant.

FIG. 30 shows an aberration that can possibly occur with a prior art bottle in use by a chewing infant with the bottle lowered below a horizontal orientation for ready grasping by the infant. This bottle 1 has a cylindrical tube of constant diameter. With a down inclined bottle, the tube contacts the feeding liquid. When the nipple is quickly compressed, as during chewing, the compressed air above the liquid pressurizes the liquid briefly within the container. The compressed air advances from the nipple through the vanes of the insert and into the container, pressurizing it. The pressurized air can possibly force the liquid up into the prior art vent tube having straight and constant diameter walls, but only when the inferior end of the venting tube is submerged in the liquid. The liquid in the vent tube can possibly enter the insert where it may possibly exit the bottle through the lateral ports of the insert.

Figure 30A:
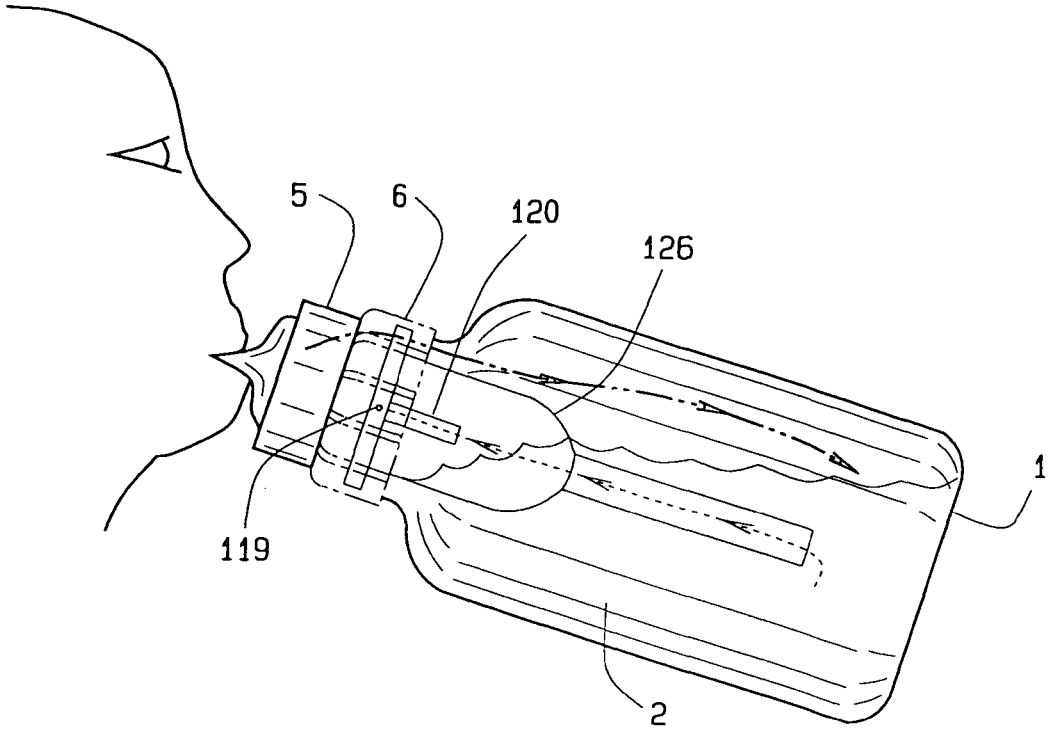
FIG. 30A PRIOR ART
FIG. 30A shows a prior art vented bottle with a cylindrical tube utilizing a narrow neck bottle and showing no leakage during use by an infant.

FIG. 30A then shows an embodiment of the present invention, demonstrating that no leakage will occur in the conditions of a narrow neck container, small volume of compressible air in the nipple, cylindrical vent tube terminating below the surface of the liquid, and the rapid compression of the small volume nipple.

Figure 31:
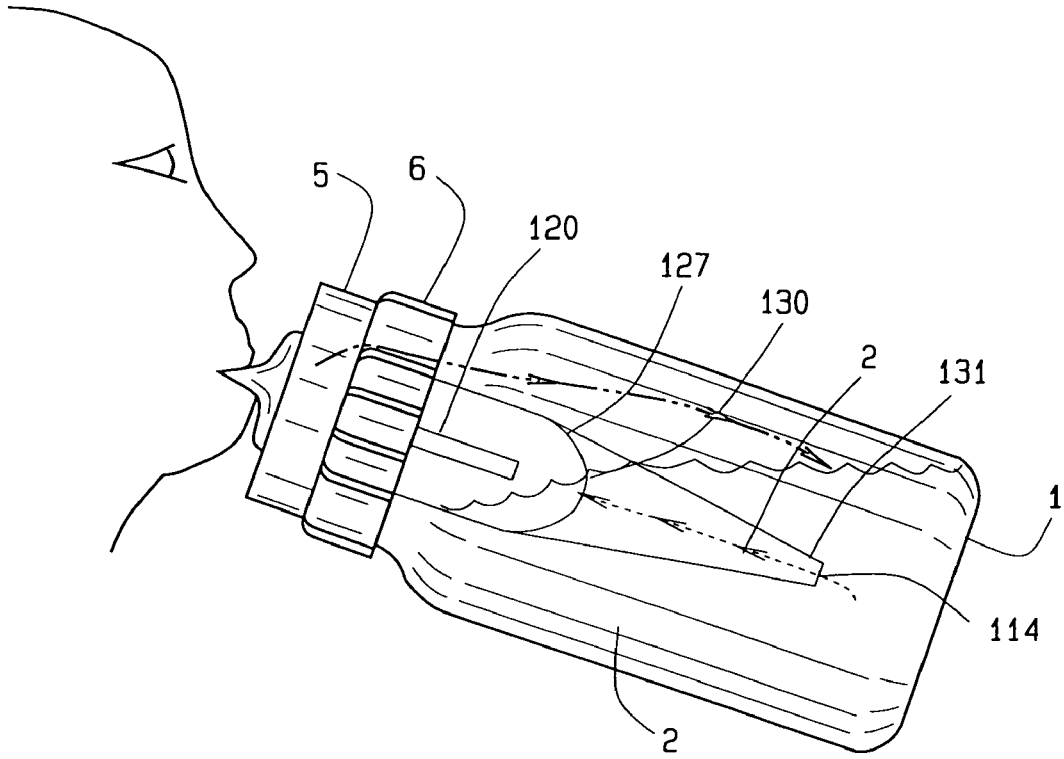
FIG. 31 shows a vented bottle with a conical venting tube upon a wide neck bottle without any leakage during use by an infant.
Figure 31A:
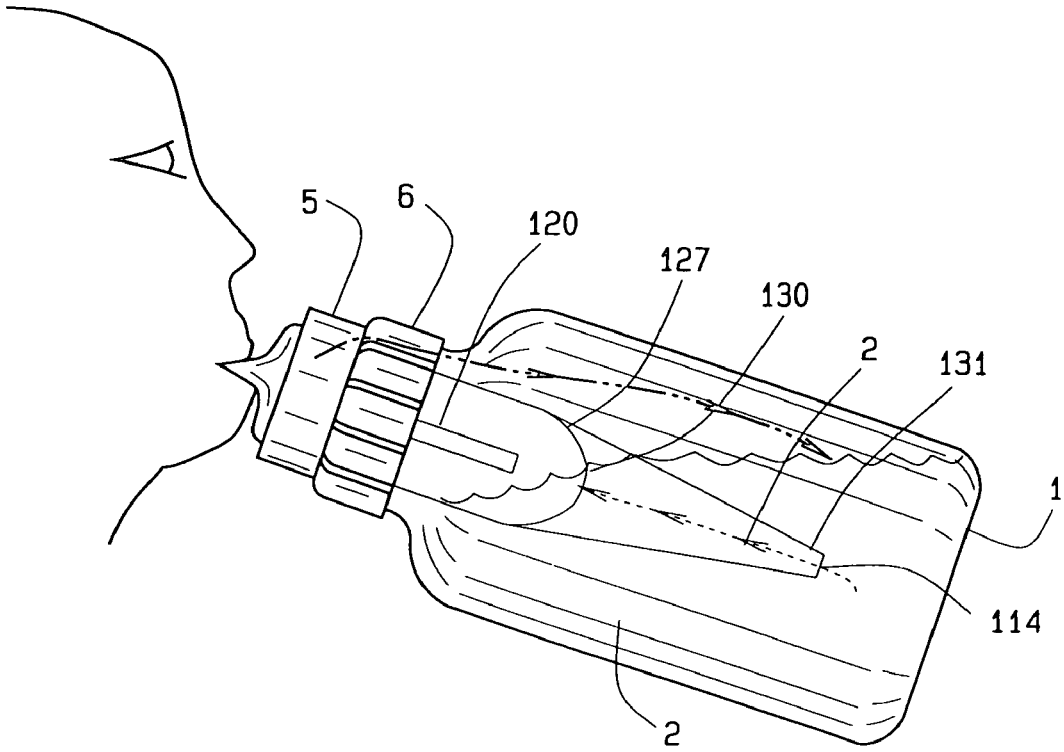
FIG. 31A shows a vented bottle with a conical venting tube upon a narrow neck bottle without any leakage during use by an infant.

The conical vent tube of the present invention, shown in FIG. 31, dissipates the feeding liquid induced into the vent tube. A conical shaped tube dissipates the pressure upon the liquid within the tube as the tube diameter expands and the feeding liquid gently flows into the reservoir instead of the lateral tube of the insert which rarely occurs in the prior art. Again, this aberration in the prior art, except that of the inventors, can only occur with a combination of a cylindrical vent tube being submerged in the feeding liquid, wide necked nipple having a large volume of compressible air, and the infant quickly compressing the air in the large volume nipple. Then as later shown in FIG. 31A, no leaks occur with a feeding container with a narrow or standard neck bottle, small volume nipple, conical vent tube terminating below the surface of the liquid, rapid compression of a small volume nipple.

Where a bottle 1 in FIG. 31 has a vent tube of a conical shape and increasing diameter from the narrow distal end 131 to the wider proximal end 130, an infant chewing on the nipple 5 could pressurize the liquid 2 but the increasing diameter of the conical vent tube increases the incremental volume inside the tube and deters feeding liquid 2 from entering the insert 119, as shown in FIG. 30, and leaking out of the collar 6. The increasing conical vent tube diameter limits any pressure increases within the bottle 1 and thus the possibility of leaks from the bottle are prevented by the present invention. Thus, the propulsion of liquid to the insert cannot occur in a narrow neck bottle, see FIGS. 30A, 31A, with either a cylindrical or conical venting tube due to the smaller amount of compressible air in the smaller nipple. The movement of liquid into the insert in the wide neck bottle with the larger diameter nipple, that is a greater volume of compressible air, can only occur, rarely, when a cylindrical venting tube is used and is submerged in the liquid while in the resting position and only with rapid compression of the wide necked nipple as in FIG. 30. When a conical shaped venting tube is used at any time, as in FIGS. 31, 31A, or when a narrow, or standard, bottle diameter is used, as in FIGS. 30AA, 31A, this phenomenon can never occur.

Figure 32:
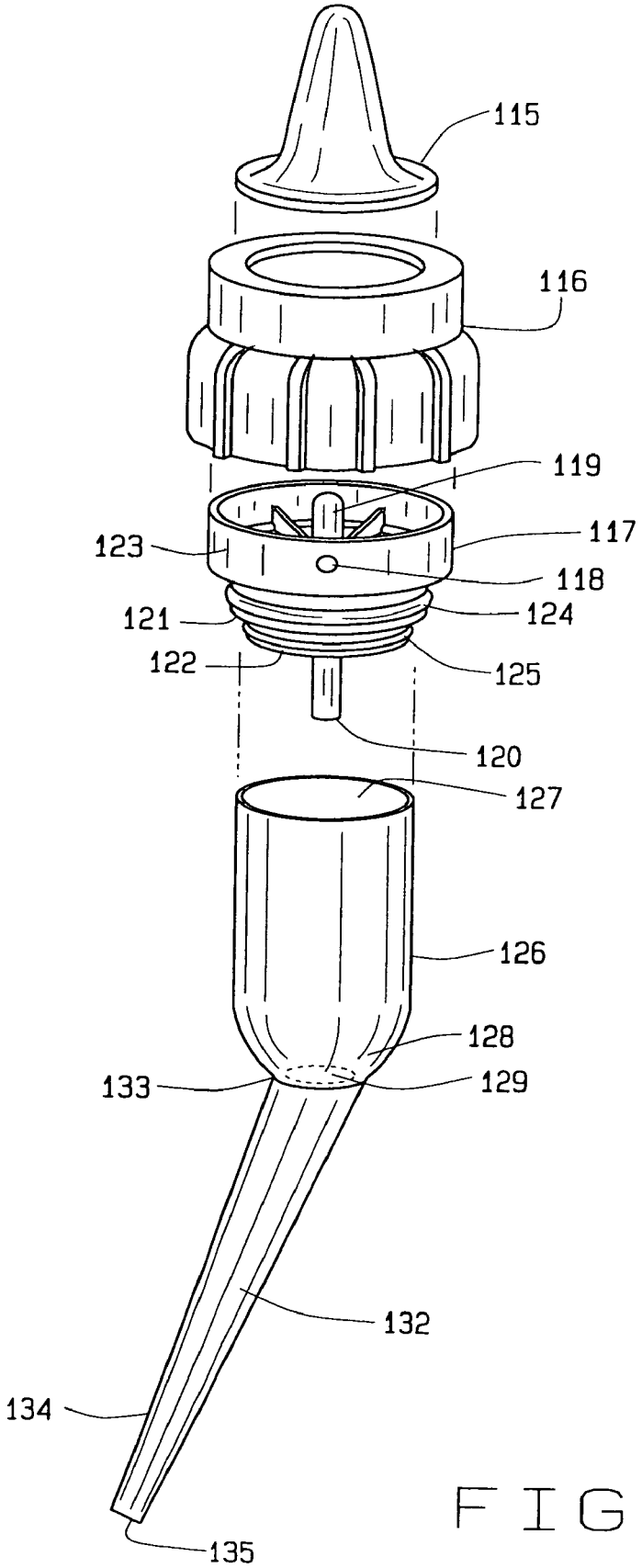
FIG. 32 is an exploded view of the canted conical vent tube and appurtenant components.

The bottle components shown in FIG. 32 share similarities with those shown previously in FIG. 27. This embodiment of the invention appears as an exploded view of the components less the liquid container or bottle. A nipple 115 extends out from a collar 116 that secures to the bottle 1, as shown earlier in FIG. 31. Between the collar and the bottle, a vent insert 117 grasps the rim of the bottle 1. The vent insert has a generally hollow cylindrical shape with a low height perimeter wall. Across the diameter, the vent insert 117 has a lateral vent 119 with a centered hole towards the bottle. The lateral vent has two opposed openings that generally communicate air between the bottle 1 and the atmosphere. The insert 117 has the lips and other features thereof as previously described. In this manner, the vent insert can be applied in a tight seal within the rim of the bottle as its first seal, with the second seal achieved by mating on the top edge of the feeding container, during its installation, and thereby preventing any leakage of liquid from the vent insert, however, the desirable air venting from the structure of the insert and its applicability and usage in a nursing container is preserved. The internal vent tube 120 descends from the vent insert 117 into the reservoir 126 when the present invention is assembled. The internal vent tube 120 is a hollow cylinder of a length in excess of its diameter. The internal vent tube 120 communicates air, but not feeding liquid in the current invention, from the lateral vent 119 into the reservoir 126 of the vent tube 132. The internal vent tube 120 is generally parallel to the longitudinal axis of the reservoir.

The vent tube 132 has a reservoir 126 with a generally hollow cylindrical shape with an open top 127 and a partially closed bottom 128 as before. The bottom is smoothed and rounded as it descends distally from the top. At the center of the bottom 128, an aperture 129 provides passage to the vent tube 132 joined to the bottom. The vent tube then attains a hollow truncated conical shape at an angle to the plane of the aperture. Generally the vent tube is bent or canted unlike the previous embodiments. The cant of the vent tube matches the angle of the nursing bottle later shown in FIG. 35. The vent tube 132 is also at an angle to the internal vent tube 120. The larger diameter 133 of the vent tube is located towards the reservoir 126 and the narrow diameter 134 located distal from the reservoir. The vent tube 132 has an aperture 135 at the narrower diameter through which air vents to the bottom of the bottle.

Figure 33:
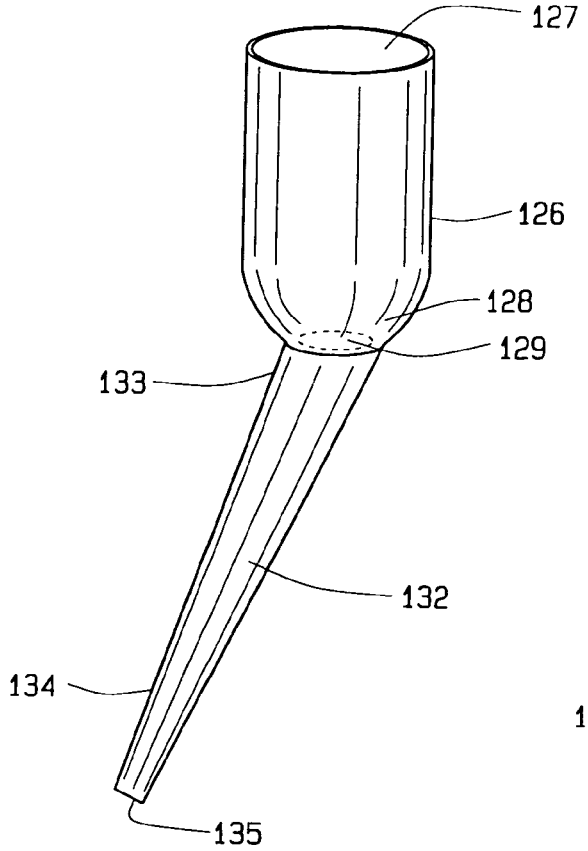
FIG. 33 is an isometric view of the canted conical vent tube having a wide diameter proximally.

FIG. 33 shows the vent tube 132 separated from the other components of the nursing bottle. The vent tube 132 has a large diameter 133 proximate to and similar in diameter to the bottom 128 of the reservoir 126. The vent tube 132 then tapers distally towards the narrow diameter 134 and outwards and away from the centerline or longitudinal axis of the reservoir. In the preferred embodiment, the vent tube has an angle of about approximately 15 to about approximately 25 degrees.

Figure 34:
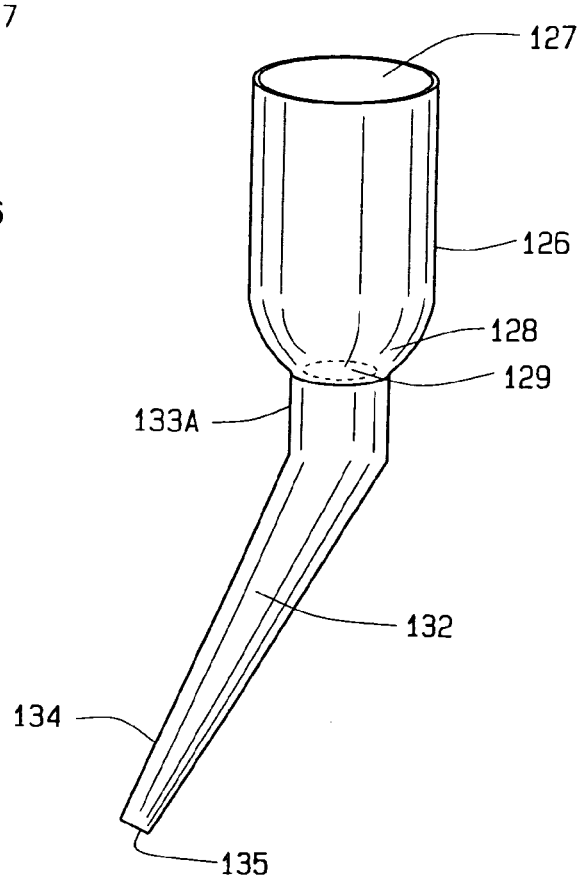
FIG. 34 is an isometric view of the canted conical vent tube having a spout proximally and the narrow diameter distally.

FIG. 34 shows the vent tube 132 again without the vent insert and other components of the nursing bottle. In this embodiment, the vent tube has a cant as before but has a spout 133A that connects to the reservoir. The spout is generally a hollow cylinder and of similar diameter to the aperture 129 of the reservoir. The spout is also coaxial with the reservoir and spaces apart the larger diameter 133 of the vent tube from the reservoir. The spacing apart aids in fitting the canted vent tube within an angled nursing bottle. As before, towards the narrow diameter 134, the vent tube 132 tapers distally and angles outward from the centerline. In this embodiment, the large diameter 133 is greater than the narrow diameter 134, generally in the range of 2:1 to 3:1.

Figure 35:
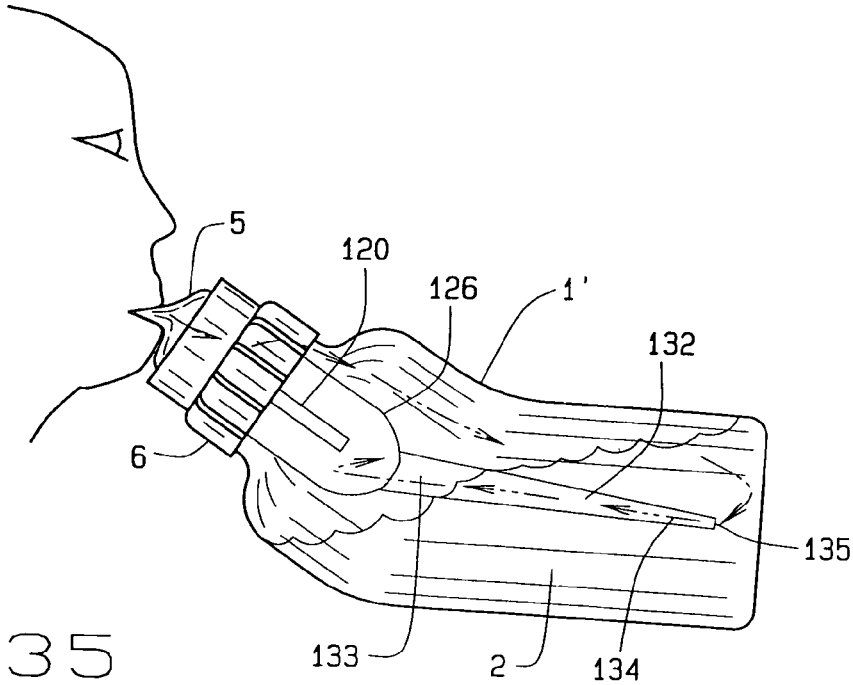
FIG. 35 shows a vented bottle with a canted tube without a leak in the upright position being held by an infant.

The tapered vent tube of an embodiment, shown in FIG. 35, dissipates the pressure of the feeding liquid induced into the vent tube of an angled bottle. A conical shaped tube at an angle to the centerline of the bottle dissipates the pressure upon the liquid within the tube as the tube diameter expands and the feeding liquid gently flows into the reservoir instead of possibly flowing into the venting tube of the insert. The cant of the vent tube also keeps it spaced apart from the wall of the bottle. The angle of the container or bottle eases grasping of the bottle by an infant with developing motor skills and reminds the caregiver to keep the head of the infant in a more raised position. Where an angled bottle 1' in FIG. 35 has a vent tube 132 including a conical shape and increasing diameter from the narrow distal end 134 to the wider proximal end 133, an infant chewing on the nipple 5 may cause pressure to be applied to the liquid 2 but the increasing diameter of the vent tube increases the incremental volume inside the tube and deters feeding liquid 2 from possibly entering the insert 119, as shown in FIG. 30, and leaking out of the collar 6. The increasing vent tube diameter dissipates any pressure increases occurring within bottle 1' when it is a wide neck bottle utilizing larger nipples that have a greater volume of compressible air, and thus the possibilities of leaks are prevented by the present invention.

Figure 36:
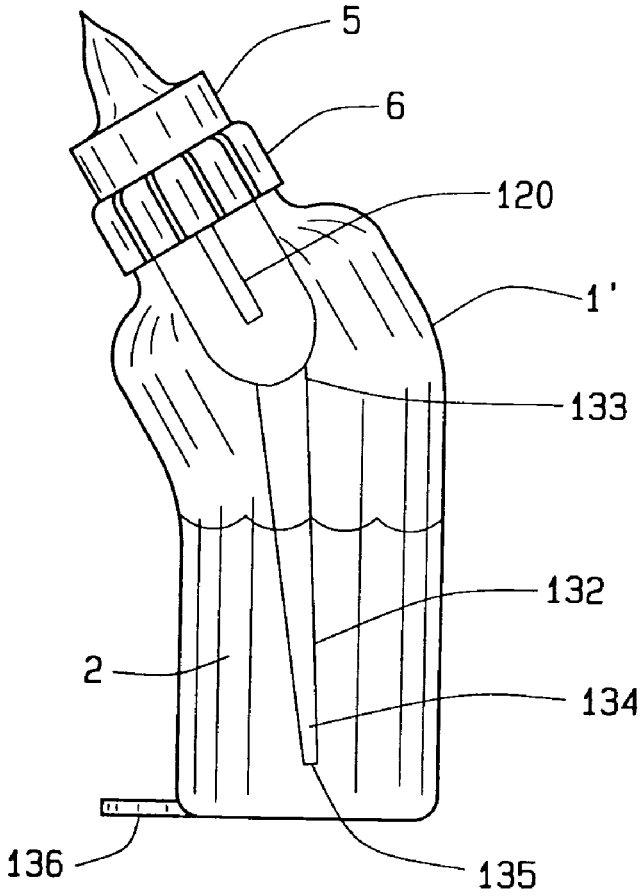
FIG. 36 describes a side view of the vented bottle with a canted tube when the vented bottle is positioned upright.

Another embodiment appears upright in FIG. 36. The angled bottle 1' has a nipple 5 secured upon the bottle with a collar 6. The reservoir 126, as seen in FIG. 32, connects to the vent insert 120 opposite from the nipple. The canted tube 132 used in this embodiment descends from the upper portion of the bottle 1' into the feeding liquid 2 here shown in the lower portion of the bottle. This bottle has an angle that extends the nipple away from the centerline of the bottle. The extended nipple and connecting parts move the center of gravity of the bottle away from the center of the bottle. If feeding liquid rises to the upper portion of the bottle, the center of gravity of the bottle moves in the horizontal direction of the nipple. With the center of gravity moved far enough outwards, the bottle 1' has a risk of tipping. The present invention has a foot like stabilizing base 136 joined to the bottom of the bottle that extends also in the horizontal direction of the nipple. The stabilizing base extends the tipping point from the edge of the bottle to the edge of the stabilizing base. An extending tipping point reduces the risk of a full or nearly full angled bottle 1' tipping over when placed in an upright position.

Figure 37:
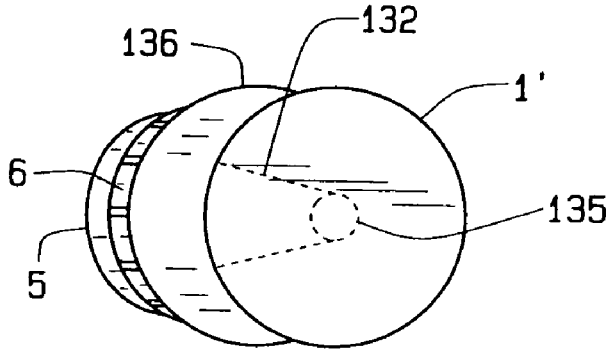
FIG. 37 shows a bottom view of the vented bottle having a stabilizing base or foot.

FIG. 37 shows the angled bottle 1' from the bottom with the stabilizing base 136 installed. The stabilizing base 136 joins to the bottom of the bottle 1' and provides a flat and continuous surface upon which the bottle 1' stands. In this embodiment, the stabilizing base is crescent shaped with the widest part of the crescent located upon a line between the center of the bottle, shown by the narrow diameter 135 of the vent tube, and the nipple shown obscured by the collar 6. The stabilizing base tapers in width until the stabilizing base approaches the bottle tangentially at two opposed points. The stabilizing base 136 itself has a generally flat planar shape with two curved, crescent shaped edges, an outer convex edge and an inner concave edge. The concave edge of the stabilizing base joins to the bottom of the bottle 1' as previously described.

Figure 38:
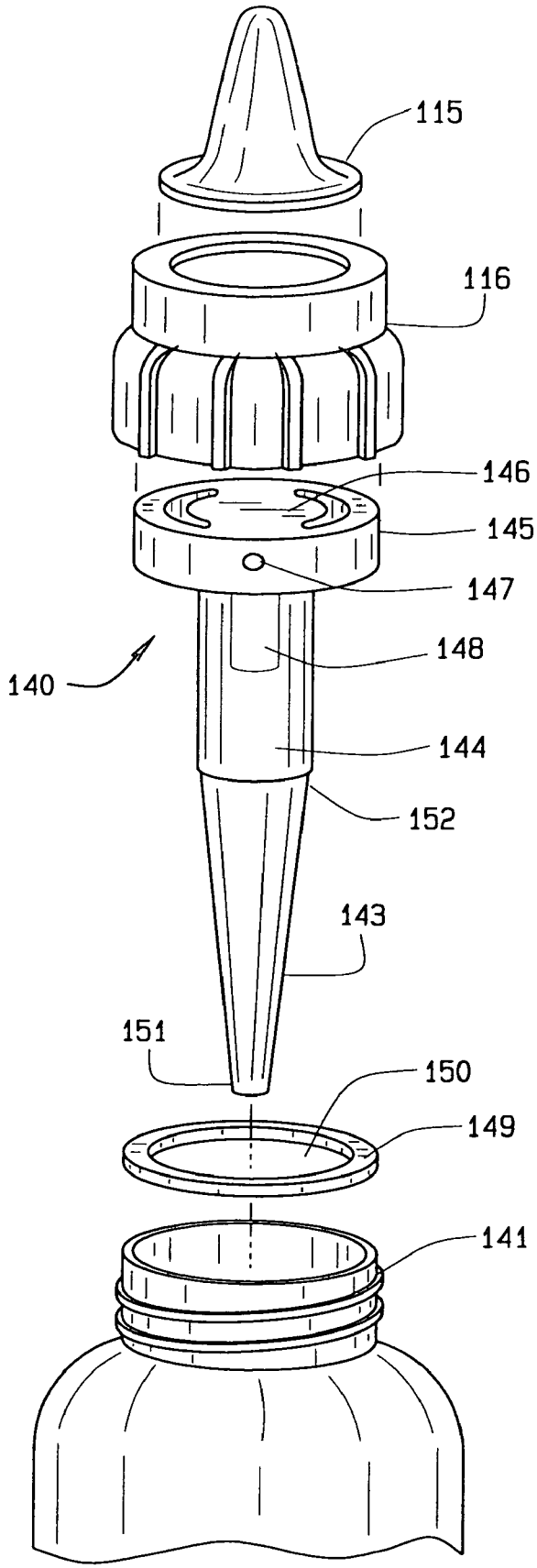
FIG. 38 illustrates an exploded view of this embodiment of the present invention.

The fully vented wide rim bottle with a single piece insert 140, combining the reservoir and venting tube, is shown in FIG. 38. In this exploded view, the present invention releases feeding liquid to an infant with any vacuum in the container being eliminated through the single piece insert 140, particularly the venting tube portion 143 later described, to the atmosphere. As before, the present invention has a container, generally cylindrical but of a length approximately one third more than the diameter. This container is designed for holding approximately 60 ml or 2 fl. oz. of feeding liquid, a suitable volume for a small infant. This container volume may easily be increased or decreased for convenience or preference. The container has a neck 141 upon one end. The container of feeding liquid has a generally cylindrical shape and is approximately 130 mm in height, 50 mm in diameter, and has a uniform wall thickness of approximately 3 mm. The superior end, or neck, of the bottle has circumferential external threads that cooperate with a collar 116. The collar, as before, is a hollow cylinder with flutes upon the edge for grasping. One end of the cylinder is partially closed with a flange that has a central opening for admitting a nipple 115. The nipple has a distal end with a hole for releasing feeding liquid.

Generally, a feeding nipple is approximately 20 mm in diameter and 40 mm in height. The nipple has a small, precisely manufactured hole in its distal end to allow for the release of feeding liquid from the container, through the nipple. The inferior surface of the nipple is a generally flat round flange so as to mate in a flush manner with the superior surface of the insert portion that itself rests upon the neck of the container. In one embodiment, the releasing device for the fluid container is shaped as a nipple, the superior aspect of the nipple has a generally cylindrical shape, approximately 14 mm in diameter and 21 mm in height. A circular collar having internal female threads holds the nipple, or other device, in place upon the insert which rests upon the neck of the container as its threads engage the male threads 141 upon the neck. When the collar is turned completely upon the neck, the nipple or other device, is firmly secured to the superior aspect of the insert portion.

Between the collar and the container, the present invention has the single piece insert with its reservoir and conical venting tube, generally coaxial with the center of the container. The single piece venting structure begins with a conical venting tube 143 that opens at the internal bottom of the container. The venting tube is hollow and has a conical shape. The venting tube typically has a length of at least two diameters and joins to a reservoir 144. The reservoir has a constant diameter that is larger than that of the venting tube. The reservoir is at least two diameters in length and has the general form of a hollow cylinder. The reservoir has a volume with a volumetric center, an upper end affixed to the insert and an opposite lower end from which the venting tube extends. The upper end of the reservoir joins to an insert portion 145 that spans the neck of the container. The lower end joins to the venting tube previously described. In addition, a vent 148 proceeds inferiorly from the horizontal aperture of the insert and terminates in the volumetric center of the reservoir.

The venting tube has a hollow tapering shape, as at 143, with the smaller diameter 151 at the internal bottom of the container and a larger diameter 152 where the venting tube joins to the reservoir.

The insert portion has sufficient diameter to reach the neck and to cover the circumference of the neck. A rib 146 spans across the diameter of the insert portion and has two ends that connect with the annular, or ring like, insert portion. An aperture 147 forms the aperture portion of the insert of the present invention. Later shown in FIG. 39C, the aperture portion has a continuous aperture that has one end terminating to the outside air and the opposite end terminating in the volumetric center of the reservoir. Upon one end, a horizontal aperture 147 extends from the outer edge of the insert portion and through the rib to the center of the rib. At the center of the rib, the horizontal aperture connects to a vent 148. The vent extends below the rib, perpendicular to the insert portion, and into the reservoir. The insert vent is generally a hollow cylinder of lesser diameter than the reservoir. The vent extends to approximately half of the length of the reservoir. Preferably, the horizontal aperture 147 extends across the entire diameter of the insert portion and again meets the vertical aperture 149 in the center of the horizontal section of the aperture, such that a T shaped connection of apertures is formed.

Between the insert portion and the neck, the present invention includes a gasket 149. The gasket is generally round, planar in shape, and has a central opening 150 to admit the reservoir through the neck. The gasket compresses and fills voids between the neck 141 and the insert portion 145 when the collar 116 secures the insert portion and the nipple upon the neck. Alternatively, the gasket is removed from the invention.

Figure 39A:
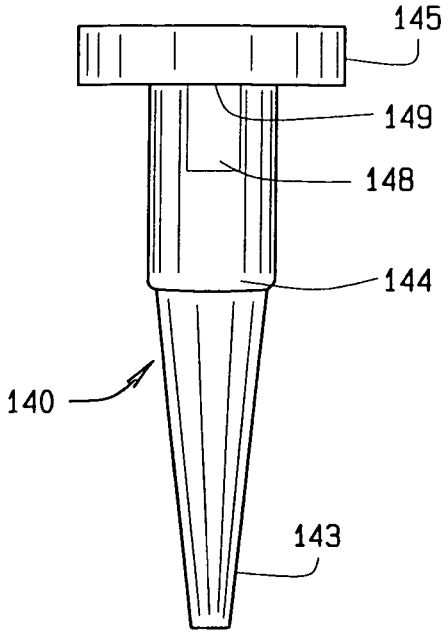
FIG. 39*a* shows a side view of the reservoir of the present invention.

The venting mechanism has a component, the insert portion 145, that rests upon the gasket atop neck of the bottle, or container, a reservoir 144 and a conical venting tube 143 generally perpendicular and centered below the insert and reservoir portions. The insert portion, reservoir, and the conical venting tube are combined into a single piece insert, generally of T shape shown in a detailed view in FIG. 39A. The insert portion 145 has a generally round shape with a rib (not shown) spanning across the insert portion and a vent 148 depending below the rib. The inferior aspect of the vent 148 terminates in the volumetric center of a cylindrical reservoir 144. The reservoir is preferably formed as a single piece including the venting tube 143, vent 148, and the insert portion 145. Alternatively, the reservoir is joined to the insert portion by sonic welding, thermal welding, solvent or chemical welding, spin, or rotational welding, friction or snap fitting, and like means of securing the insert portion to the reservoir thus forming a single piece venting mechanism. Extending toward the bottom of the container from the lower end of the reservoir 144, the conical venting tube 143 terminates slightly above the interior bottom of the container and has a conical shape through its length. Alternatively, a differently shaped tube may be used that also terminates near the bottom of the container.

Figure 39B:
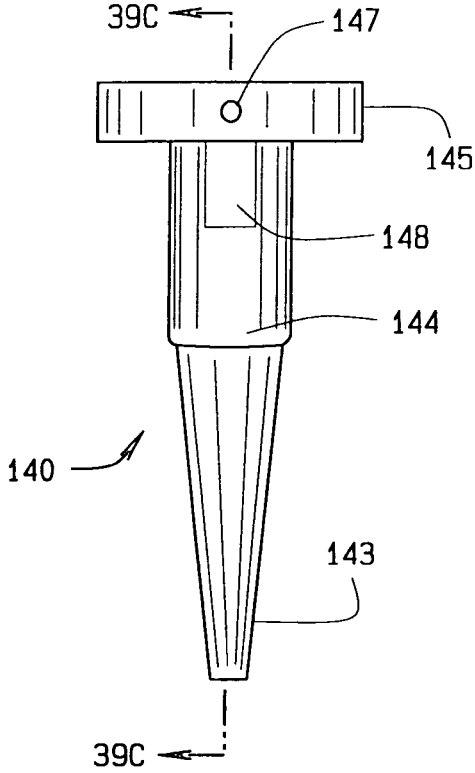
FIG. 39*b* shows a side view of the reservoir centered upon the insert portion.
Figure 39C:
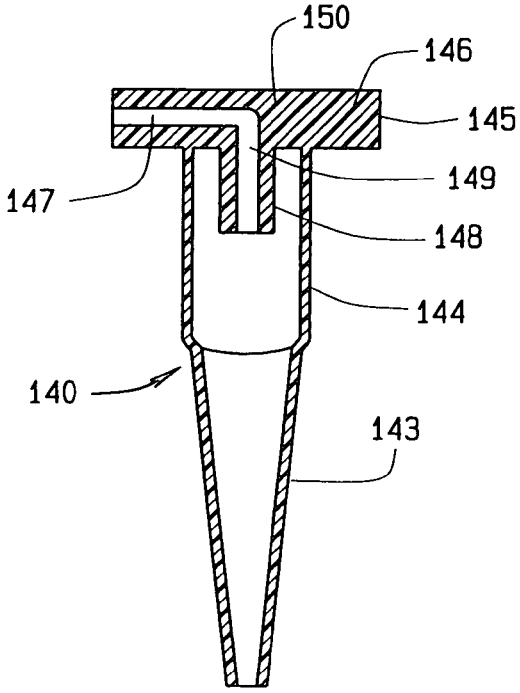
FIG. 39*c* shows a sectional view of the reservoir through the horizontal aperture.

Turning the single piece vent tube provides FIG. 39B. Here the insert portion has a generally round shape with a horizontal aperture 147 upon the circumference that continues through a rib 146, also shown in FIG. 39D, across the diameter of the insert portion. Generally centered in the rib, a hole 149 communicates with the horizontal aperture and the vent 148 connects below the rib at the hole. The reservoir 144 itself also connects to the central portion of the rib, outwards of the vent. The flow path for air through the single piece vent tube is shown in FIG. 39C. The insert portion has a horizontal aperture 147 that opens at the circumference of the insert portion. The horizontal aperture continues through the rib 146 to the center where it communicates to a hole 149 centered in the lower surface of the rib where the vent 148 connects.

Figure 39D:
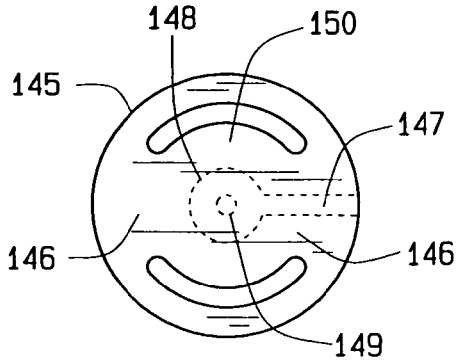
FIG. 39*d* shows a top view of the reservoir.

Viewing the single piece vent from above in FIG. 39D, the insert portion is shown where the insert portion 145 has a generally round, annular shape, with a central rib 146 spanning the diameter of the insert portion. The rib has a horizontal aperture 147 as before that opens upon the edge of the insert portion for communicating with the atmosphere. The horizontal aperture continues through the rib along a radius of the insert portion, here shown in phantom. The horizontal aperture connects to a hole 149 partially through the thickness of the central portion 150 of the rib and then to the vent 148.

Figure 40:
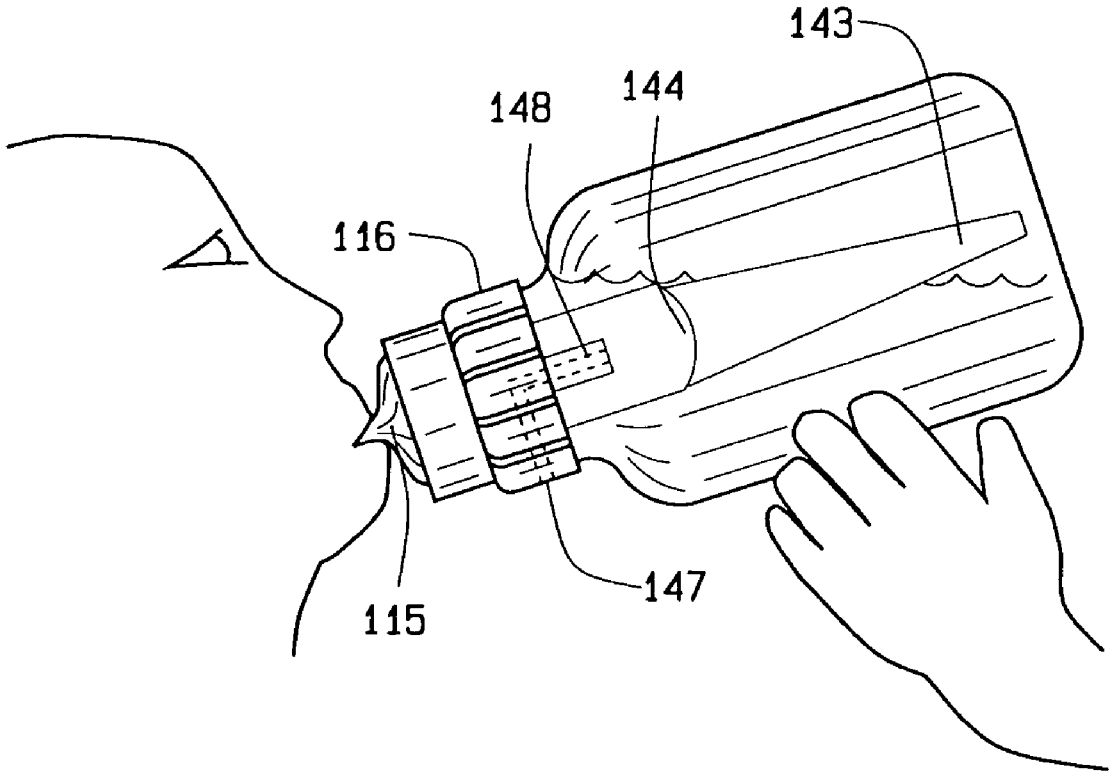
FIG. 40 has the present invention in use with the vertical venting tube that emanates from the horizontal venting tube terminating at the volumetric center of the reservoir.

Having described the components and arrangement of them, the present invention is used by an infant in cooperation with a caregiver as shown in FIG. 40. With the container in a feeding position, raised to an angle above the horizontal, venting air flows through the threads of the neck and into the horizontal aperture, through the hole in the rib and into the vent, down into the reservoir, and then into the adjoining conical venting tube where it exits at the bottom of the container. The entrance of air through the venting tube eliminates the formation of a vacuum within the container and its associated adverse transfer into an infant's oral cavity and associated structures.

The venting mechanism of the present invention permits an uninterrupted flow of air into the container, thereby eliminating any vacuum formation in the container. This airflow occurs without mixing any air into the feeding liquid or without any feeding liquid escaping, that is leaking, from the container. Additionally, when the container is held in an inverted feeding position, the feeding liquid now flows through the openings in the insert portion between the annular edge and the rib, and then into the nipple or other liquid dispensing attachment. Furthermore, the liquid in the tapering venting tube flows quickly and gently into the reservoir. The liquid becomes trapped within the reservoir below the volumetric center and the inferior end of the venting tube. Any air that remains in the venting system readily enters into the container bottom similar to the air entering the venting mechanism through the neck of the container.

When the container is returned to a vertical position, as when the neck is deviated upwardly, the liquid trapped in the reservoir now flows down into the venting tube to pool with the remaining liquid in the container, again, without mixing air into the liquid or liquid leaking from the container. In the preferred embodiment of the venting tube, the superior end increases the effective volume of the reservoir.

Returning to an inverted position, the tapered embodiment of the venting tube allows liquid to flow quickly and easily into the reservoir and allows air initially within the reservoir to quickly enter the bottom space of the container. In a vertical position, the tapered venting tube increases the overall volume capacity of the reservoir.

The usage of the present invention is similar to that of the inventors' previously patented feeding containers. The present venting mechanism, here a single piece, is inserted, venting tube first, into the container where the insert portion rests upon a gasket upon the neck. Alternatively, no gasket is present. Upon the insert, a feeding nipple is generally placed though other devices may attach as well. The feeding nipple is held firmly to the neck via the insert and by a collar threadily engaging the neck. The nipple has an aperture, or hole, for release of feeding liquid, with the size of the aperture determining the rate of flow of the liquid from the container, where a larger hole leads to faster flow of liquid.

The present invention has a unique simultaneous operation of the container with both air and feeding liquid. Airflow proceeds around the threads of the neck of the fluid filled container, through the insert portion, into the vent tube depending from the center of the insert portion, into the cylindrically shaped reservoir, then into the preferred conically shaped venting tube, or alternatively a cylindrically shaped venting tube, and exits at the internal bottom of the container. This airflow eliminates contamination of the liquid within the container with air. The conical shape of the venting tube of the reservoir eases the release of air from the vent tube into the inferior aspect of the feeding container when inverted during feeding time.

When inverted, the feeding liquid in the reservoir venting tube, now flows gently into the large diameter portion of the reservoir and remains there until the bottle, or container, is again placed upright when the liquid exits the reservoir downward and pools with the remainder of liquid within the bottle. The reservoir prevents the liquid from reaching the vent tube depending from the insert portion, located in the volumetric center of the reservoir, by several mechanisms when the bottle is inverted. First, the reservoir, with its conical venting tube, reduces the force of the liquid approaching the vent tube of the insert portion. Second, the preferred embodiment of the conical venting tube allows the feeding liquid therein to move more quickly and easily into the reservoir. During such movement, the air in the conical venting tube more easily exits to the inferior, or bottom of the bottle. Third, the reservoir increases its effective volume as the taper of the preferred embodiment of the venting tube temporarily stores feeding liquid.

These mechanisms allow for complete and continuous venting of the container at all times without contamination of the liquid with air and also prevents any leakage. The container accommodates the liquid that remains in different parts of the venting mechanism at different times during usage. These mechanisms allow the present invention to function as a vent and accommodate fluid, separate air and fluid at all times, and prevent leaks from the container when in any position.

From the aforementioned description, a fully vented wide rim, or other diameter, nursing bottle with a single piece insert has been described. This nursing bottle is uniquely capable of eliminating negative pressure continuously and automatically in a bottle or container. This nursing bottle and its various components may be manufactured from many different materials including but not limited to polymers, low density polyethylene, high density polyethylene, polypropylene, glass, nylon, ferrous and non-ferrous metals, their alloys, silicone, and composites. For an example, the feeding container may be made of polypropylene, polycarbonate, polyethylene, or other suitable material. And, the collar for fastening the nipple upon the feeding container may be made of polyethylene, polypropylene, or other material, and the adjacent feeding nipple is preferably made of silicone, or another material.

Variations or modifications to the subject matter of this invention may occur to those skilled in the art upon reviewing the development as described herein. Such variations, if within the scope of this development, are intended to be encompassed within the principles of this invention, as explained herein. The descriptions of the preferred embodiment, in addition to the depiction within the drawings, are set forth for illustrative purposes only.

We claim:

1. A nursing bottle assembly having a container with a closed bottom end, a top end opposite said bottom end and having an opening therein for receiving liquid into an interior of the container, a rim at the top end also with an inner diameter defining the size of the opening at the top end, a nipple, and a threaded collar to provide sealing between said nipple and said top end while allowing liquid to flow from said container to said nipple, and to provide closure for the opening at the top end, wherein the improvement comprises:

a single piece insert generally providing venting to said bottle assembly, having an integral insert portion, an integral vent depending from the center of said insert portion, an integral reservoir depending from the center of said insert portion with said vent within said reservoir, and an integral venting tube in communication with said reservoir and depending from said reservoir;

said insert portion sealing to said top end and having a horizontal aperture therethrough for communicating with the inner space of said container;

said vent being in communication with said horizontal aperture and having a length approximately one half that of said reservoir;

said venting tube having a distal end disposed proximate the bottom of said container and being open to the inner space of the container to facilitate venting;

said reservoir having a generally hollow cylindrical shape with an upper end joined below said insert portion and an opposite lower end;

said vent having a constant diameter and a distal end, and being generally perpendicular to said insert portion; and an inner space of said reservoir having a volumetric capacity and a volumetric center, and said distal end of said vent generally opening near the volumetric center of said reservoir.

2. The nursing bottle assembly of claim 1 further comprising:

said venting tube having a constant diameter.

3. The nursing bottle assembly of claim 1 further comprising:

said venting tube having a conical shape with a larger diameter proximally towards said reservoir and a narrow diameter distally.

4. The nursing bottle assembly of claim 3 wherein said larger diameter of said venting tube is no more than the diameter of said reservoir and exceeds the diameter of said vent.

5. The nursing bottle assembly of claim 1 further comprising:

a gasket, locating upon said rim and below said single piece insert.

6. A container for dispensing fluids during nursing having a closed bottom end, a top end having an opening therein for receiving liquid into the interior of the container, a rim at the top end also with an inner diameter defining the size of the opening, a threaded collar, a nipple, and said container having a volume suitable for a premature infant, comprising:

a single piece insert to generally close and to ventilate the inner space of the container during usage, said insert sealing to said top end, and having an integral insert portion, an integral vent depending from said insert portion with a distal end disposed generally perpendicular to said insert portion and within the inner space of the container, an integral reservoir disposed outwardly from said vent, generally coaxial and depending from said insert portion, and an integral venting tube depending from said reservoir;

said insert portion having a horizontal aperture for communicating through said vent to the inner space of said container;

said venting tube having a constant diameter and an end away from said reservoir, said end locating proximate the bottom of said container and being open to the inner space of said container;

said reservoir having a cylindrical shape, an upper end joined to said insert portion, and a lower end in communication with said venting tube;

an inner space of said reservoir having a volumetric capacity and a volumetric center;

said vent having a length approximately half that of said reservoir and the end of said vent being disposed generally near the volumetric center;

said insert portion having a generally annular shape and a rib extending diametrically across said insert portion;

said horizontal aperture extending through said rib and approximate the center of said rib communicating with said vent; and said rib widening in the vicinity of the center to receive said upper end of said reservoir.

7. A container for dispensing fluids during nursing having a closed bottom end, a top end having an opening therein for receiving liquid into the interior of the container, a rim at the top end also with an inner diameter defining the size of the opening, a threaded collar, a nipple, and said container having a volume suitable for feeding an infant, comprising:

a single piece insert to generally close and to ventilate the inner space of the container during usage, said insert sealing to the top end, and having an integral insert portion, an integral vent depending from said insert portion with a distal end disposed generally perpendicular to said insert portion and within the inner space of the container, an integral reservoir disposed outwardly from said vent, generally coaxial and depending from said insert portion, and an integral venting tube depending from said reservoir;

said insert portion having a horizontal aperture for communicating through said vent to the inner space of said container;

said venting tube having a conical shape, a larger diameter proximally and a narrow diameter distally and disposed generally near the bottom of said container and being open to the inner space of said container;

said reservoir having a cylindrical shape, an upper end joined to said insert portion, and a lower end in communication with said venting tube;

an inner space of said reservoir having a volumetric capacity and a volumetric center;

said insert portion having a generally annular shape and a rib extending diametrically across said insert portion;

said horizontal aperture extending through said rib and proximate the center of said rib communicating with said vent; and said rib widening in the vicinity of the center to receive said upper end of said reservoir.

8. The nursing bottle assembly of claim 7 further comprising:

a gasket, locating upon said rim and below said single piece insert.

9. The container for dispensing fluids of claim 7 wherein said larger diameter of said venting tube is no more than the diameter of said reservoir and exceeds the diameter of said vent.

* * * * *

UNITED STATES PATENT AND TRADEMARK OFFICE

CERTIFICATE OF CORRECTION

PATENT NO. : 8,113,365 B2
APPLICATION NO. : 12/321455
DATED : February 14, 2012
INVENTOR(S) : Craig E. Brown et al.

It is certified that error appears in the above-identified patent and that said Letters Patent is hereby corrected as shown below:

On the Title Page In Column 1,
Item 63 should be added:

Related U.S. Application Data

This non-provisional application for patent claims priority to the provisional application 60/773,265 which was filed on Feb. 14, 2006, which claims priority to the non-provisional patent application Ser. No. 11/258,966 which was filed on Oct. 25, 2005, which claims priority to the non-provisional patent application Ser. No. 11/152,320 which was filed on Jun. 14, 2005, which claims priority to the non-provisional patent application having Ser. No. 10/283,878, which was filed on Oct. 30, 2002; which was filed during the pendency of PCT application Serial No. US2001/014,365 which was filed on May 4, 2001 designating the U.S., and which claimed priority to the U.S. provisional application Ser. No. 60/202,851 filed on May 8, 2000.

This provisional application for patent further claims priority to the design patent application Ser. No. 29/226,482 which was filed on Mar. 29, 2005.

Signed and Sealed this
Fifth Day of May, 2015

Michelle K. Lee

Michelle K. Lee
*Director of the United States Patent and Trademark Office*